US007134458B2

(12) United States Patent
Horibe et al.

(10) Patent No.: US 7,134,458 B2
(45) Date of Patent: Nov. 14, 2006

(54) METHOD OF PRODUCING REINFORCING FIBER WOVEN FABRIC AND PRODUCTION DEVICE THEREFOR AND REINFORCING FIBER WOVEN FABRIC

(75) Inventors: Ikuo Horibe, Matsuyama (JP); Kiyoshi Momma, Omihachimon (JP); Akira Nishimura, Kyoto (JP)

(73) Assignee: Toray Industries, Inc., Tokyo (JP)

( * ) Notice: Subject to any disclaimer, the term of this patent is extended or adjusted under 35 U.S.C. 154(b) by 135 days.

(21) Appl. No.: 10/491,275

(22) PCT Filed: Apr. 1, 2002

(86) PCT No.: PCT/JP02/03253

§ 371 (c)(1),
(2), (4) Date: Mar. 31, 2004

(87) PCT Pub. No.: WO03/031703

PCT Pub. Date: Apr. 17, 2003

(65) Prior Publication Data

US 2004/0221909 A1 Nov. 11, 2004

(30) Foreign Application Priority Data

Oct. 1, 2001 (JP) ..... 2001-305178
Nov. 20, 2001 (JP) ..... 2001-354192

(51) Int. Cl.
*D03D 45/02* (2006.01)
*D03D 15/00* (2006.01)

(52) U.S. Cl. ..... 139/452; 139/420 R; 139/426 R; 139/420 A; 139/DIG. 1

(58) Field of Classification Search ..... 139/452, 139/420 R, 426 R, 420 A, DIG. 1; 242/905; 226/97.4
See application file for complete search history.

(56) References Cited

U.S. PATENT DOCUMENTS 3,575,217 A * 4/1971 Pfarrwaller ..... 139/452

(Continued)

FOREIGN PATENT DOCUMENTS

JP 58-191244 11/1983

(Continued)

OTHER PUBLICATIONS

International Search Report dated Apr. 30, 2002, application No. PCT/JP02/03253.

(Continued)

*Primary Examiner*—Gary L. Welch
*Assistant Examiner*—Robert H. Muromoto
(74) *Attorney, Agent, or Firm*—RatnerPrestia

(57) ABSTRACT

A method of producing a reinforcing fiber woven fabric, for producing on a weaving machine a reinforcing fiber woven fabric from wefts of reinforcing fiber yarns and warps of reinforcing fiber yarns, the method comprising providing, on a weft supply passage for supplying a weft from a weft bobbin to the weaving machine, a weft unwinding means for laterally unwinding weft from the weft bobbin, and a weft storing cylinder body for sucking along with air, part of weft thus unwound and directed toward the weaving machine and temporarily storing it therein, contactingly supporting weft, minimized in generation of twist by means of lateral unwinding, by a weft contacting means provided in the weft storing cylinder body while being stored in the weft storing cylinder, and preventing the generation of twist of weft being stored by the supporting; a production device therefore, and a reinforcing fiber woven fabric produced therefrom.

29 Claims, 5 Drawing Sheets

U.S. PATENT DOCUMENTS

| | | | | |
|---|---|---|---|---|
| 3,731,713 | A * | 5/1973 | Lachapelle et al. | 139/452 |
| 3,964,657 | A * | 6/1976 | Lenk et al. | 226/177 |
| 4,271,570 | A * | 6/1981 | Curzio | 28/290 |
| 4,821,781 | A * | 4/1989 | van Bogaert et al. | 139/435.4 |
| 4,986,316 | A * | 1/1991 | Morohashi et al. | 139/452 |
| 5,150,739 | A * | 9/1992 | Blackwell et al. | 139/452 |
| 5,529,094 | A * | 6/1996 | Nishimura et al. | 139/435.1 |
| 6,726,139 | B1 * | 4/2004 | Persson | 242/365.3 |

FOREIGN PATENT DOCUMENTS

| | | | |
|---|---|---|---|
| JP | 4-44023 | | 7/1992 |
| JP | 05-294555 | | 11/1993 |
| JP | 7-300738 | A | 11/1995 |
| JP | 10-331056 | | 12/1998 |
| JP | 11-1839 | A | 1/1999 |
| JP | 2000-273745 | A | 10/2000 |
| WO | WO 96/31428 | A | 10/1996 |

OTHER PUBLICATIONS

Partial European Search Report, application No. EP 02 70 7278, dated Aug. 29, 2005.

* cited by examiner

METHOD OF PRODUCING REINFORCING FIBER WOVEN FABRIC AND PRODUCTION DEVICE THEREFOR AND REINFORCING FIBER WOVEN FABRIC

This is a U.S. National Phase of International Application Number PCT/JP02/03253 filed Apr. 1, 2002.

1. Technical Field

The present invention relates to a method and apparatus for producing a reinforcing fiber woven fabric for using a fiber reinforced composite material comprising reinforcing fibers and a matrix material combined with the reinforcing fibers, and relates to a reinforcing fiber woven fabric produced by the method or apparatus. As a typical reinforcing fiber yarn, carbon fiber yarn is known, and as a typical matrix material, a synthetic resin is known.

2. Background Art

A woven fabric (a carbon fiber woven fabric) formed from carbon fiber yarns having a high specific modulus and a high specific strength is usually woven by a general shuttle loom or rapier loom. A carbon fiber woven fabric and a synthetic resin are integrated with each other and molded into a predetermined shape for producing a carbon fiber-reinforced plastic (CFRP).

The CFRP is being used, for example, as a structural material of aircraft because of its excellent performance. For further expanding an applicable range of CFRP, it is desired that not only the cost of molding but also the cost of intermediate products such as carbon fiber yarns and woven fabrics formed from the carbon fiber yarns could be reduced.

The larger thickness, i.e., the larger fineness of the carbon fiber yarn, the higher productivities in production of a precursor for the carbon fiber yarn and in processes for imparting flame resistance and for burning to produce the carbon fiber yarn from the precursor are obtained. This method makes production of an inexpensive carbon fiber yarn possible.

However, each of weaving yarns of an ordinary carbon fiber woven fabric comprises a carbon fiber yarn consisting of a bundle of numerous carbon filaments, and a profile of cross section of each of the weaving yarns (the carbon fiber yarns) is almost circular. For that reason, in a carbon fiber woven fabric produced from the weaving yarns, a profile of cross section of weaving yarn (carbon fiber yarn) at intersection of a weft yarn and a warp yarn is oval, and the weaving yarn (carbon fiber yarn) is greatly crimped. Especially, in a carbon fiber woven fabric formed with thick carbon fiber yarns, this tendency is great since thick weft yarns and thick warp yarns cross each other.

Accordingly, a carbon fiber woven fabric comprising greatly crimped carbon fiber yarns composed of weaving yarns has an irregularity of fiber density, and did not exhibit sufficiently characteristic of high strength of carbon fibers. Further, since a carbon fiber woven fabric formed with thick carbon fiber yarns generally has a large unit weight of fabric and a large thickness of fabric, a resin impregnability in the carbon fiber woven fabric tends to be low at forming a prepreg or a fiber-reinforced plastic (FRP).

Therefore, a CFRP produced by using a carbon fiber woven fabric formed with thick carbon fiber yarns and a resin has numerous voids existing in the resin, and cannot be expected to exhibit high strength.

On the other hand, in a carbon fiber woven fabric formed with thick carbon fiber yarns and having a small unit weight, clearances formed between carbon fiber yarns become large. For that reason, where a carbon fiber woven fabric with a small unit weight is used to produce a molded CFRP, a percentage of content of carbon fiber yarn is small, and voids in a resin are produced intensively in portions of the clearances formed between the carbon fiber yarns and as a result there was a disadvantage in the carbon fiber woven fabric that a CFRP having a high performance cannot be obtained thereby.

To overcome the disadvantage, a thin woven fabric having a thickness of not more than 0.09 mm and a unit weight of not more than 85 g/m$^2$, woven with flat carbon fiber yarns having a thin thickness and a wide width, and a method for producing thereof are proposed in JP-A-58-191244. As the thin woven fabric has a very thin thickness, the extent of crimp of the weaving yarn is small, and the woven fabric exhibits a high reinforcing effect is excellent for molding a thin CFRP.

A weaving process for producing a carbon fiber woven fabric based on the flat carbon fiber yarns comprises shedding sequentially a warp yarns sheet supplied from a warp beam having carbon fiber yarns as many as necessary wound around it or supplied from carbon fiber yarn bobbins as many as necessary installed on a creel, by means of a heald, and inserting a weft yarn into a shedding by means of a shuttle or rapier.

Concerning warp yarns, there are methods of a beam supplying and a direct supplying from bobbins, and in either case, one of the two methods consisting of a tangential unwinding in which a warp yarn is unwound from a bobbin rotating slowly and a longitudinal unwinding in which a warp yarn is unwound from a bobbin in the axial direction of the bobbin is used.

Concerning a weft yarn, as a general weft yarn supplying method, a method comprising unwinding a weft yarn longitudinally from a bobbin wound on a reinforcing fiber yarn, pulling the unwound yarn into a yarn feeding guide, and inserting the weft yarn under hooking of the weft yarn by a claw of a rapier is used.

According to the method, in the case where the weft yarn is an ordinary yarn, unwinding of the weft yarn from the bobbin is performed relatively smoothly for intermittent insertion of the weft yarn by the rapier.

However, in the case where a weft yarn is a carbon fiber yarn, especially in the case where the carbon fiber yarn has a sizing agent deposited thereon for improving handling property of the yarn, there was a problem that fluffing or breaking of fibers occurs during unwinding in a moment in longitudinal direction from the bobbin, since the yarn wound on the bobbin is likely to adhere to itself in the adjacently placed portions.

Further, there was a problem that during the longitudinal unwinding, the yarn is twisted once in a length corresponding to one turn around the bobbin, and in the case where a flat yarn is used to produce a woven fabric, it brings a problem that a yarn width of the flat yarn becomes extremely narrow and a woven fabric becomes one having irregularity in yarn width.

For solving these problems, it becomes essential to unwind a weft yarn from a bobbin in lateral direction. A feeding method of a weft yarn in a weaving of a carbon fiber woven fabric, comprising unwinding a weft yarn from a bobbin in lateral direction and storing a portion of the weft yarn which is unwound and proceeded to a weaving means is proposed in JP-B-4-44023. In the method, a weft yarn bobbin is forcibly rotated and feeds a weft yarn having a length being necessary for one time of weft yarn insertion.

Further, a dancer pulley is used for storing the weft yarn by means of an up-and-down movement of its roller. According to the method, it becomes possible to prevent occurrence of fluffing or twisting during taking-out of the weft yarn since the weft yarn is laterally unwound.

However, in the case where a weft yarn has a sizing agent deposited thereon, since the yarn is likely to adhere to itself in its adjacently placed portions on the bobbin, it happens that when a rotational number the bobbin is changed in response to a storing volume of the weft yarn while the bobbin is forcibly rotated, the weft yarn is fed from the bobbin in an arbitrary direction. Especially in the case where a loom is operated at high speed, an excessive yarn length is drawn from the bobbin by an overrunning at a time of.

Further, since the dancer pulley is suddenly raised when the weft yarn is inserted, the weft yarn is highly tensioned, and the rapier is likely to fail in holding the weft yarn or the weft yarn is likely to be broken. Moreover, in the case of high-speed operation, there arises such a problem that since the responding speed in the vertical motion of the dancer pulley cannot follow the weft insertion speed and a tension of the weft fluctuates more greatly, a twist occurs in the weft yarn and a tension of the weft yarn becomes unstable.

On the other hand, as a method for reducing the fluctuation of weft tension, a weft yarn storing method using expansion and contraction of a spring is proposed in JP-A-10-331056. The method improves fluctuation of tension of a weft yarn remarkably by imparting tension to the weft yarn under an expansion of a spring.

However, also in the method, in high-speed operation, a responding speed in the expansion and contraction of the spring cannot follow the weft insertion speed and a tension of the weft yarn becomes unstable. Especially where the weft yarn becomes loosened, twist occurs in the yarn, and in the case where the weft yarn is a flat yarn, there arises a problem that the flat state cannot be maintained.

Further, it is possible to use a spring comprising a wire having larger diameter to raise a responding speed, but in this case, a weft yarn tension at the time of storing becomes so large that yarn holding failure and yarn breaking are likely to occur at the time of insertion of the weft yarn.

A device for storing a weft yarn for a carbon fiber woven fabric is proposed in JP-A-5-294555. In the device, a weft yarn bobbin is positively rotated to pay out a weft yarn that is then stored in a storage tank by means of air suction, and top and bottom yarn sensors installed in the storage tank are used to control a length of the weft yarn stored therein. Since the device uses an air resistance caused by air suction, it does not happen that the weft yarn is excessively tensioned when the yarn is stored.

However, since the weft yarn bobbin is positively rotated in response to the length of weft yarn stored, there arises a problem that an excessive length of yarn is fed by an overrunning at the starting time and before the weft yarn reaches the air suction storage tank, it is loosened and likely to be twisted.

Furthermore, since a winding diameter changes in relation with a volume of the yarn remaining on the bobbin, the on-off control at a constant rotation cannot keep the weft feed rate in constant, and especially in the case where the winding diameter of the weft yarn bobbin is large, there arises a problem that the overrun at the time when the bobbin is stopped becomes large.

It can also be considered that the length of the weft yarn stored in the storage tank is increased for obviating the loosening of the yarn due to the time lag between the detection of the stored yarn length and the start of bobbin rotation, but in this case, since the length of the weft yarn stored in the storage tank becomes too long, there arises a problem that the weft yarn placed in the storage tank is likely to be twisted.

Moreover, the weft yarn sucked into the storage tank is apart from wall surfaces of the storage tank, and is left free along a yarn passage kept out of control within the storage tank. So, curls of the weft yarn formed when it is wound around the bobbin remain potentially in the yarn and are likely to be reproduced, and there arises a problem that the yarn is likely to be twisted in the storage tank, being affected by the disturbance of air flow in the storage tank. Especially in the case where the weft yarn is a flat yarn, it is more difficult to maintain the flat state.

The curls of the weft yarn formed when it is wound around the bobbin, which remain potentially in the weft yarn, become remarkable when the weft yarn is a flat yarn. Each curl of a flat yarn is formed when the flat yarn traversing in the axial direction of the bobbin is reversed in traversing direction at an end of the bobbin. At the reversed portion, the flat yarn is bent in its width direction.

When the flat yarn is bent, the filaments constituting the inside portion of the yarn at the bend are loosened, and the filaments constituting the outside portion of the yarn at the bend are tensioned. In this state, the flat yarn is temporarily set, while it is wound around the bobbin. The temporarily set state is reproduced as a curl when the flat yarn is unwound from the bobbin in the case where the tension acting on the yarn is low or in the case where the yarn is liberated from any outside constraint.

An object of the invention is to provide a method and apparatus for producing a reinforcing fiber woven fabric, which solves the problems of the prior art, and minimizes a fluctuation of weft yarn tension in a weft yarn feeding passage for a weft yarn fed from a weft yarn bobbin to a weaving means, thereby substantially solving the problem of twisting likely to occur in the weft yarn fed in the weft yarn feeding passage.

Another object of the invention is to provide a method and apparatus for producing a reinforcing fiber, especially applicable to a loom operated in high speed.

A further object of the invention is to provide a bi-directional reinforcing fiber woven fabric formed from flat warp yarns and flat weft yarns, produced by the method and apparatus for producing a reinforcing fiber woven fabric of the invention.

DISCLOSURE OF THE INVENTION

A method for producing a reinforcing fiber woven fabric of the invention comprises forming the reinforcing fiber woven fabric by using a loom including a weft yarn bobbin being wound a weft yarn comprising a reinforcing fiber yarn, a weaving means for interlacing the weft yarn unwound from the weft yarn bobbin with plural of warp yarns each of which comprises reinforcing fiber yarn separately supplied for forming a woven fabric, a weft yarn feeding passage through which the weft yarn proceeding from the weft yarn bobbin to the weaving means is passed, a weft yarn unwinding means provided in the weft yarn feeding passage for laterally unwinding the weft yarn from weft yarn bobbin, and a weft yarn storing means provided in the weft yarn feeding passage for temporarily storing a segment of the weft yarn proceeding to the weaving means, characterized in that (A) the weft yarn storing means comprises a weft yarn storing cylinder, (B) the weft yarn storing cylinder has a weft yarn gate opened to outside air at one end thereof and an air releasing port for sucking and releasing air in the weft yarn storing cylinder at the other end thereof, and (C) the weft yarn storing cylinder has a weft yarn contact means for forming a yarn passage by contacting with the weft yarn located therein which is drawn into the weft yarn storing cylinder through the weft yarn gate under function of air sucking and releasing brought by the air releasing port; and (D) positioning the weft yarn gate along with the weft yarn feeding passage, drawing the segment of the weft yarn which is unwound from the weft yarn bobbin, passed through the weft yarn gate and proceeded to the weaving means, into the weft yarn storing cylinder under function of air sucking and releasing brought by the air releasing port, and storing temporarily the segment of the weft yarn in the weft yarn storing cylinder under supporting the weft yarn with the weft yarn contact means.

In the method for producing a reinforcing fiber woven fabric of the invention, it is preferable that the weft yarn unwinding means has a constant speed unwinding mechanism for unwinding the weft yarn from the weft yarn bobbin at a constant speed and a tensioning mechanism for imparting a tension regularly to the weft yarn.

In the method for producing a reinforcing fiber woven fabric of the invention, it is preferable that the weft yarn unwinding means has a bobbin rotating mechanism for rotating the weft yarn bobbin; and the weft yarn storing cylinder has a yarn volume detecting means for detecting a volume of the weft yarn located in the weft yarn storing cylinder and delivering an output signal corresponding to the volume, and a bobbin rotation control mechanism for controlling a rotation of the weft yarn bobbin by the bobbin rotating mechanism based on the output signal.

In the method for producing a reinforcing fiber woven fabric of the invention, it is preferable that the weft yarn unwinding means has a bobbin rotating mechanism for rotating the weft yarn bobbin, and a tensioning mechanism for imparting a tension regularly to the weft yarn; and the weft yarn storing cylinder has a yarn volume detecting means for detecting a volume of the weft yarn located in the weft yarn storing cylinder and delivering an output signal corresponding to the volume, and a bobbin rotation control mechanism for controlling the rotation of the weft yarn bobbin by the bobbin rotating mechanism based on the output signal.

The apparatus for producing a reinforcing fiber woven fabric of the invention is an apparatus for producing a reinforcing fiber woven fabric by using a loom which comprises a weft yarn bobbin being wound a weft yarn comprising a reinforcing fiber yarn, a weaving means for interlacing the weft yarn unwound from the weft yarn bobbin with plural of warp yarns each of which comprises a reinforcing fiber yarn separately supplied for forming a woven fabric, a weft yarn feeding passage through which the weft yarn proceeding from the weft yarn bobbin to the weaving means is passed, a weft yarn unwinding means provided in the weft yarn feeding passage for laterally unwinding the weft yarn from the weft yarn bobbin, and a weft yarn storing means provided in the weft yarn feeding passage for temporarily storing a segment of the weft yarn proceeding to the weaving means, characterized in that (A) the weft yarn storing means comprises a weft yarn storing cylinder, (B) the weft yarn storing cylinder has a weft yarn gate opened to outside air at one end thereof and an air releasing port for sucking and releasing air in the weft yarn storing cylinder at the other end thereof, and (C) the weft yarn storing cylinder has a weft yarn contact means for forming a yarn passage by contacting with the weft yarn located therein which is drawn into the weft yarn storing cylinder through the weft yarn gate under function of air sucking and releasing brought by the air releasing port; and (D) the weft yarn gate is positioned in face to the weft yarn feeding passage.

In the apparatus for producing a reinforcing fiber woven fabric of the invention, it is preferable that the weft yarn unwinding means has a constant speed unwinding mechanism comprising nip rollers for unwinding the weft yarn from the weft yarn bobbin at a constant speed, and a tensioning mechanism comprising a tension roller for imparting a tension to the weft yarn.

In the apparatus for producing a reinforcing fiber woven fabric of the invention, it is preferable that the weft yarn unwinding means has a bobbin rotating mechanism comprising a bobbin rotating drive motor for rotating the weft yarn bobbin, and a tensioning mechanism comprising a tension roller for imparting a tension regularly to the weft yarn; and the weft yarn storing cylinder has a yarn volume detecting means for detecting a volume of the weft yarn located in the weft yarn storing cylinder and delivering an output signal corresponding to the volume detected, and a bobbin rotation control mechanism for controlling a rotation of the weft yarn bobbin by the bobbin rotating mechanism based on the output signal.

It is preferred that the peripheral edges of the weft yarn gate of the weft yarn storing cylinder have at least a first side and a second side parallel to each other; an inlet guide at the side of yarn leading-in is provided along the first side, to be kept in contact with the weft yarn coming from the weft yarn bobbin into the weft yarn storing cylinder; and an outlet guide at the side of yarn leading-out is provided along the second side, to be kept in contact with the weft yarn destined to go out from inside the weft yarn storing cylinder toward the weaving means.

It is preferred that the weft contact means located in the weft yarn storing cylinder comprises a guide at the side of yarn leading-in to be kept in contact with the weft yarn leading-in from the inlet guide and a guide at the side of yarn leading-out to be kept in contact with the weft yarn leading-out from the outlet guide; and a distance between the guide at the side of yarn leading-in and the guide at the side of yarn leading-out in the direction perpendicular to the direction of the inlet guide gradually decreases from the weft yarn gate toward the air releasing port.

It is preferred that the guide at the side of yarn leading-in and the guide at the side of yarn leading-out are respectively formed of an air permeable sheet.

It is preferred that the guide at the side of yarn leading-in and the guide at the side of yarn leading-out are respectively formed of a plurality of parallel rods spaced apart each other.

It is preferred that a cross sectional figure of the inner circumferential surface of the weft yarn storing cylinder is rectangular.

It is preferred that in the case where the cross sectional figure of the inner circumferential surface of the weft yarn storing cylinder is rectangular, the inlet guide is located along one of the short sides of the rectangle and the outlet guide is located along the other short side of the rectangle.

It is preferred that a suction rate of air from the weft yarn gate due to an action at the air releasing port is in a range from 0.05 to 100 $m^3$/min.

It is preferred that a rotational speed of the loom is in a range from 100 to 400 rpm.

The reinforcing fiber woven fabric of the invention is a bi-directional woven fabric formed with warp yarns comprising reinforcing fiber yarns and weft yarns comprising reinforcing fiber yarns, wherein the woven fabric satisfies the following relations: YW≧4 mm, WTR=40 to 100, YWvc≦10%, and WminPR≧0.8, where YW is the yarn width of each of the reinforcing fiber yarns; YT is the yarn thickness; WTR is the width/thickness ratio (YW/YT) of yarn width (YW) to yarn thickness (YT); YWvc is the yarn width variation coefficient; YWmin is the minimum yarn width; YP is the weaving yarn pitch; and WminPR is the width/pitch ratio(YWmin/YP) of the minimum yarn width (YWmin) to the weaving yarn pitch (YP).

The value of the width/thickness ratio WTR being 40 or more means that the cross sectional figure of the reinforcing fiber yarn is a flat yarn.

It is preferred that the total fineness of each of the reinforcing fiber yarns is in a range from 500 to 70,000 decitex.

It is preferred that the woven fabric satisfies FCf=98 to 100%, where FCf is the cover factor of the woven fabric.

The cover factor FCf is a factor relating to the voids formed between the weaving yarns of a woven fabric, and refers to the value defined by the following formula:

$$\text{Cover factor } FCf\,(\%)=[(S1-S2)/S1]\times 100$$

where S1 is a set area of the woven fabric, and S2 is the area of void portions formed by the weaving yarns in the area S1.

It is preferred that the reinforcing fiber yarns are carbon fiber yarns.

The reinforcing fiber woven fabric of the invention has a yarn width (YW) of 4 mm or more and a width/thickness ratio (WTR) of 40 or more. This means that the weaving yarns have a large compression. In the case where the compression of the weaving yarns is large, when a woven fabric is formed into a final product, the woven fabric is likely to be shear-deformed and to follow a complicated shape. In order that a woven fabric can be deformed, it is necessary that while the yarn width changes, the interlacing angle formed between a warp yarn and a weft yarn must vary. A woven fabric having a yarn width (YW) of 4 mm or more and a width/thickness ratio (WTR) in a range from 40 to 100 has large shear deformability, since the degree of freedom in the change of yarn width is large.

Where a yarn width (YW) is less than 4 mm and a width/thickness ratio (WTR) is less than 40, a woven fabric cannot follow a complicated shape, since it cannot be easily shear-deformed. In the case where a complicatedly shaped product is produced using such a woven fabric, plural simply molded products must be combined to obtain the intended product. In this case, the number of parts is large, and the individual parts must be joined to raise the cost. Furthermore, the adhesiveness at the joints must also be taken into account.

In the case where the width/thickness ratio (WTR) is more than 100, the woven fabric is likely to be shear-deformed, but the shape is unstable, while the weaving yarns are likely to shift, making it inconvenient to handle the woven fabric.

The reinforcing fiber woven fabric of the invention has a yarn width variation coefficient (YWvc) of 10% or less and a width/pitch ratio (WminPR) of 0.8 or more.

In the case where an FRP was molded with a reinforcing fiber woven fabric and a thermosetting resin, the resin is going to shrink due to the temperature difference between a curing temperature and a service temperature, but the reinforcing fibers little change in dimension. As a result, the reinforcing fiber yarns inhibit the deformation of the resin, and even under no load, stresses occur at the interfaces between the fibers and the resin. If the volume of the resin is large, its curing shrinkage is also large, and hence the generated stresses also become large. On the other hand, in an FRP, portions where a volume of the resin becomes large are void portions occurred between the weaving yarns of the woven fabric and at the intersections of the weaving yarns. Therefore, for reducing generation of stresses, the volume of the void portions must be kept as small as possible.

If the woven fabric has a yarn width variation coefficient (YWvc) of 10% or less and a width/pitch ratio (WminPR) of 0.8 or more, the yarn width variation coefficient in the entire woven fabric becomes small and even the smallest yarn width is 80% or more of the weaving yarn pitch, and therefore, the volume of the void portions formed between the weaving yarns and at the intersections of the weaving yarns can be kept in small, and further it does not happen that extremely large void portions exist.

Therefore, in the case where this reinforcing fiber woven fabric is used to produce a molded FRP, the stresses generated at the interfaces between the fibers and the resin in the FRP can be kept in small. Accordingly, when a load acts on the FRP, to extend the reinforcing fibers, separation does not occur at the interfaces between the fibers and the resin when the FRP is deformed slightly, and the excellent mechanical properties of the reinforcing fiber yarns can be effectively exhibited. Moreover, if the volume of void portions becomes small, the ruggedness of the surface of FRP caused by the curing shrinkage can also be kept in small. Therefore, an FRP having a smooth surface can be obtained.

It is preferred that the reinforcing fiber yarns used in the woven fabric are carbon fibers. If carbon fibers are used as the reinforcing fiber yarns, a composite having excellent mechanical properties can be obtained, since carbon fibers have a high specific strength and a high specific modulus.

The reinforcing fiber woven fabric can be obtained using the above-mentioned method or apparatus for producing a reinforcing fiber woven fabric of the invention.

According to the method or apparatus for producing a reinforcing fiber woven fabric of the invention, a weft yarn is sucked by air into a weft yarn storing cylinder, and is kept sucked by air under constrain imparting from a weft yarn contact means provided in the weft yarn storing cylinder. As a result, the weft yarn is opened in the weft yarn storing cylinder and uncurled. Especially, the curls of a flat yarn formed by a bending at the traverse-reversing portions of the bobbin can be removed.

Therefore, the variation in the yarn width (YW) of weft yarn in the reinforcing fiber woven fabric produced as described above can be kept in small, and furthermore, even if the weft yarn is narrowed by means of beating when the woven fabric is produced, it can be uniformly widened when it is opened with air treatment at the time of weaving, since it is once opened with air treatment in the weft yarn storing cylinder.

On the other hand, warp yarns are laterally unwound from the warp yarn bobbins and are fed to the weaving means while they are tensioned to ensure that they are not twisted. In the case where the warp yarns are flat yarns, they are fed to the weaving means while being tensioned with their flat state maintained. Therefore, the yarn width variation coefficient of warp yarn can also be kept in small.

Even in the case where warp yarns and weft yarns respectively having a large compression, for example, a yarn width (YW) of 4 mm or more and a width/thickness ratio (WTR) of 40 to 100 are used as reinforcing fiber yarns, a woven fabric having a yarn width variation coefficient (YWvc) of 10% or less and a width/pitch ratio (WminPR) of 0.8 or more can be obtained.

If a flat weft yarn having potential curls is inserted, the yarn is likely to be twisted at the portions of potential curls, and if it is twisted, it becomes very small in yarn width at the twisted portions and the yarn width variation coefficient (YWvc) becomes large. In this case, if reinforcing fiber yarns having a large compression, for example, a yarn width (YW) of 4 mm or more and a width/thickness ratio (WTR) of 40 to 100 are used, a woven fabric having a yarn width variation coefficient of (YWvc) of 10% or less and a width/pitch ratio (WminRP) of 0.8 or more cannot be obtained.

Method for Measuring the Width of Warp Yarn:

In a woven fabric, at positions for defining the lengths of warp yarns as 100 cm, lines are marked along weft yarns, and the woven fabric is kept free from tension. Then, the warp yarns within 10 cm from the respective selvages of the woven fabric are removed. In the sample thus obtained, the width of the warp yarn floating at each of all the intersections of warp yarns and weft yarns is measured in parallel to the weft yarns at an accuracy of 0.1 mm. The yarn width can be measured at an accuracy of 0.1 mm using a measuring microscope.

Method for Measuring the Yarn Width of Weft Yarn:

In a woven fabric, at positions containing 50 consecutive weft yarns, lines are marked, and the woven fabric is kept free from tension. Then, the weft yarns within 10 cm from the respective selvages of the woven fabric are removed. In the sample thus obtained, the width of the weft yarn floating at each of all the intersections of warp yarns and weft yarns is measured in parallel to the warp yarns at an accuracy of 0.1 mm. The yarn width can be measured at an accuracy of 0.1 mm using a measuring microscope.

Method for Calculating the Yarn Width Variation Coefficient of Warp Yarns:

The measured yarn width values of warp are used to calculate the yarn width variation coefficient of warp yarns from the following formula.

Yarn width variation coefficient of warp yarns (%)= [Standard deviation of yarn widths of warp yarns (mm)]/[Mean value of yarn widths of warp yarns (mm)]×100

Method for Calculating the Yarn Width Variation Coefficient of Weft Yarns:

The measured yarn width values of weft yarns are used to calculate the yarn width variation coefficient of weft yarns from the following formula.

Yarn width variation coefficient of weft yarns (%)= [Standard deviation of yarn widths of weft yarns (mm)]/[Mean value of yarn widths of weft yarns (mm)]×100

Method for Calculating the Width Pitch of Warp Yarns:

The width pitch is calculated from the minimum yarn width value among the measured yarn width values of warp yarns and from the weaving pitch value of warp yarns calculated from the following formula.

Weaving yarn pitch of warp yarns (mm)=[A given interval (mm)/[Number of weaving yarns existing in the given interval]

Method for Calculating the Width Pitch of Weft Yarns:

The width pitch is calculated from the minimum yarn width value among the measured yarn width values of weft yarns and from the weaving pitch value of weft yarns calculated from the following formula.

Weaving yarn pitch of weft yarns (mm)=[A given interval (mm)/[Number of weaving yarns existing in the given interval]

In the specification, the expression that a weft yarn is stored in a weft yarn storing cylinder while being bent in U shape means that the weft yarn progresses inward from a weft yarn gate in the weft yarn storing cylinder and is returned at a certain curvature to progress outward, reaching the weft yarn gate, and includes also the case where the distance between the inward yarn passage and the outward yarn passage, i.e., the distance between the leading-in yarn and the leading-out yarn in the storing device becomes gradually shorter on the side of an air releasing port than that on the side of the weft yarn gate, that is, the case where the weft yarn is bent like virtually V shape, not like U shape.

THE BEST MODES FOR CARRYING OUT THE INVENTION

Desirable modes for carrying out the invention are described below in reference to drawings.

Figure 1:
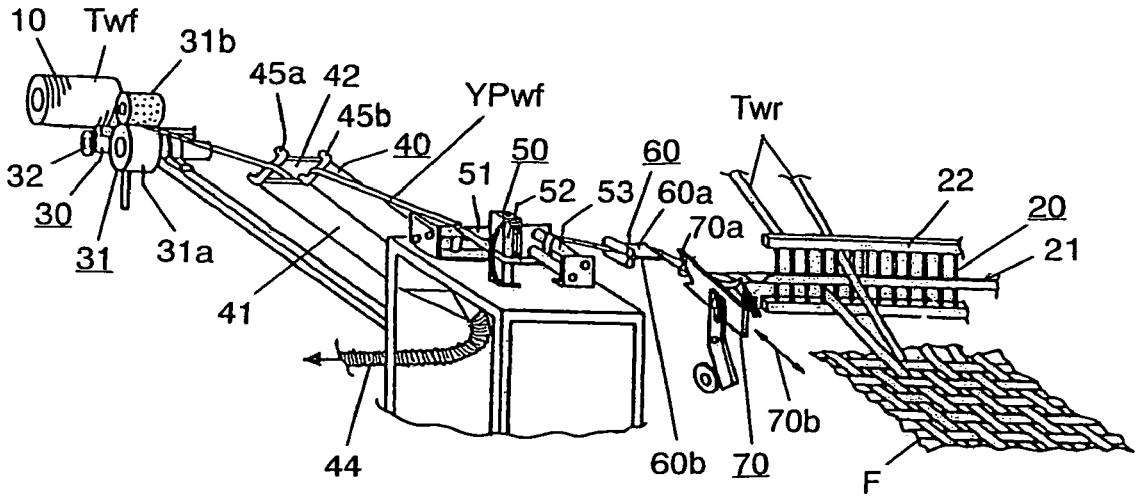
FIG. 1 is a perspective schematic front view showing an example of the apparatus used for carrying out the method for producing a reinforcing fiber woven fabric of the invention.
Figure 2:
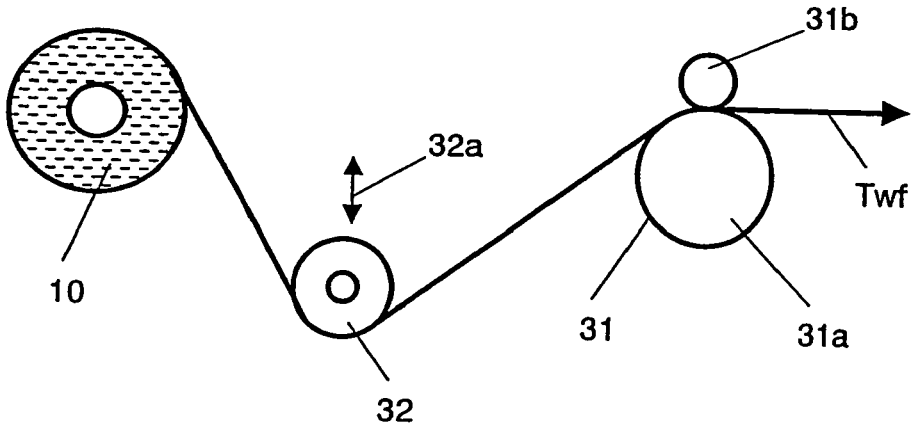
FIG. 2 is a schematic side view showing a weft yarn unwinding means in the apparatus shown in FIG. 1.
Figure 3:
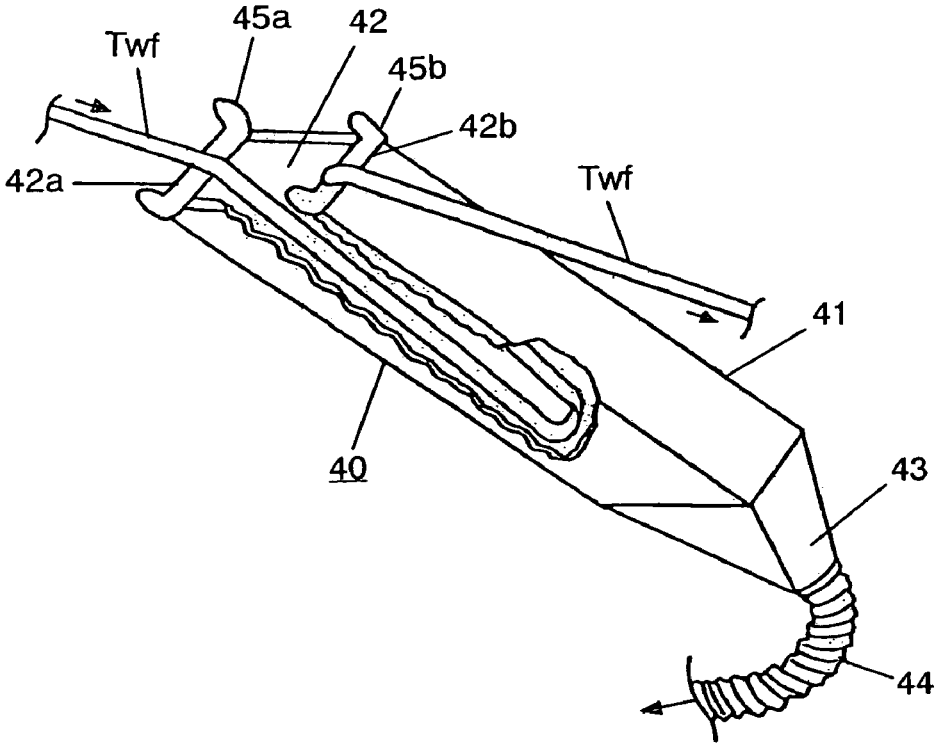
FIG. 3 is a partially sectional perspective view showing a weft yarn storing cylinder in the apparatus shown in FIG. 1.

An example of the apparatus for carrying out the method for producing a reinforcing fiber woven fabric of the invention, is shown in FIG. 1, the detail of a weft yarn unwinding means in the apparatus is shown in FIG. 2, and the detail of a weft yarn storing means in the apparatus is shown in FIG. 3.

The apparatus shown in FIG. 1 has a weft yarn bobbin 10 being wound a weft yarn Twf comprising a reinforcing fiber yarn, a weaving means 20 for interlacing the weft yarn Twf unwound from the weft yarn bobbin 10 and plural warp yarns Twr comprising reinforcing fiber yarns separately supplied for forming a woven fabric F, and a weft feeding passage YPwf through which the weft yarn proceeding from the weft yarn bobbin 10 to the weaving means 20 is passed.

The weft yarn feeding passage YPwf is provided with a weft yarn unwinding means 30 for laterally unwinding the weft yarn Twf from the weft yarn bobbin 10. The weft yarn unwinding means 30 has a constant speed unwinding mechanism comprising nip rollers 31 for unwinding the weft yarn Twf from the weft yarn bobbin 10 at a constant speed and a tensioning mechanism comprising a tension roller 32 for imparting a tension regularly to the weft yarn. The nip rollers 31 include a take-up roller 31*a* driven to rotate and a nip roller 31*b* rotated along with the rotation of the take-up roller 31*a,* and the weft yarn Twf runs while being nipped between the take-up roller 31*a* and the nip roller 31*b*.

Further, the weft yarn feeding passage YPwf is provided with a weft yarn storing means 40 for temporarily storing a segment of the weft yarn Twf destined for the weaving means 20.

Moreover, the weft yarn feeding passage YPwf is provided with a group of guide rollers 50 for guiding the weft yarn Twf. The group of guide rollers 50 includes a horizontal guide roller 51, a vertical guide roller 52 and a horizontal guide roller 53. Still furthermore, the weft yarn feeding passage YPwf is provided with a plate spring tension device 60 for keeping the weft yarn Twf tensioned, and a push plate guide 70. The weaving means 20 has a rapier 21 and a reed 22.

In the apparatus, the weft yarn Twf is guided along the tension roller 32 by means of the take-up roller 31*a* driven by the rotary main shaft (not shown in the drawings) of the loom and the nip roller 31*b,* while being unwound from the weft yarn bobbin 10 at a constant speed with the rotation of the take-up roller 31*a.* The tension roller 32 has such a mechanism that it is positioned above when the weft yarn Twf is unwound from the weft yarn bobbin 10, and automatically declines downward when the loom stops, actuating a brake interlocked with the tension roller 32 for stopping the inertial rotation of the bobbin 10. The vertical motion of the tension roller 32 is indicated by arrow 32*a*.

The unwinding speed of the weft yarn Twf is the product of the speed of the loom multiplied by the length of the weft yarn inserted into the woven fabric F. For example, if the speed of the loom is 200 rpm and the length of the inserted weft yarn is 1.1 m, then the weft-unwinding speed is about 220 m/min.

The reinforcing fiber yarns forming weft yarn Twf and warp yarns Twr are yarns composed of carbon fibers, glass fibers, aramid fibers or the like. Among them, carbon fibers having a high specific strength and a high specific modulus can be preferably used, since the availability of their mechanical properties in the composite is high.

For improving the handling convenience and the weavability into a woven fabric, it is preferred that the reinforcing fiber yarns have about 0.2 to about 2.5 wt % of a bundling agent such as a sizing agent or a coupling agent deposited for bundling. Reinforcing fiber yarns having a bundling agent deposited are prevented from fluffing even if they are abraded with yarn passage guides, and are more adhesive to the resin in the composite, to improve its mechanical properties.

A reinforcing fiber yarn retaining its form by a bundling agent is wound around a cylindrical tube called a bobbin in a certain traverse width, to form the weft yarn bobbin 10.

It is preferred that a reinforcing fiber yarn consists of 1,000 to 100,000 filaments. It is preferred that the total fineness of a reinforcing fiber yarn is 500 to 70,000 decitex. If the total fineness is less than 500 decitex, the effect of the invention cannot be exhibited, since the reinforcing fiber yarn is so thin that substantially no problem can be caused even if the yarn is twisted. If the total fineness is more than 70,000 decitex, it is difficult to insert the weft yarn by the weaving means 20 and to cut the weft yarn after completion of insertion.

In the case where a reinforcing fiber yarn is a flat yarn, it is preferred that the compression of the yarn, i.e., the width/thickness ratio (WTR) of the yarn as the ratio (YW/YT) of the yarn width (YW) to the yarn thickness (YT) is in a range from 40 to 100. In the case where the width/thickness ratio (WTR), i.e., the compression is less than 40, a woven fabric having a small unit weight cannot be obtained if the yarns have a large fineness, since the compression is too small. On the other hand, in the case where the compression is more than 100, a distance between the weaving yarns in the obtained woven fabric becomes too large, and since the warp yarns and the weft yarns are loosely constrained, it is inconvenient to handle the woven fabric.

The weft yarn Twf fed from the nip rollers 31 reaches the weft yarn storing means 40. The weft yarn storing means 40 comprises a weft yarn storing cylinder 41 as shown in FIG. 3, and the weft yarn storing cylinder 41 has a weft yarn gate 42 opened to outside air at one end thereof, and an air releasing port 43 for sucking and releasing air in the weft yarn storing cylinder 41 at the other end thereof. The air releasing port 43 is connected with a suction hose 44 that is connected with a blower (not shown in the drawings). Along one side of the weft yarn gate 42 of the weft yarn storing cylinder 41, an inlet guide 45*a* at the side of yarn leading-in is provided, and along the side opposite to the side, an outlet guide 45*b* at the side of yarn leading-out is provided.

The weft yarn Twf reaching the weft yarn storing cylinder 41 goes into the weft yarn storing cylinder 41 while being kept in contact with the inlet guide 45*a* at the side of yarn leading-in, and is stored in the weft yarn storing cylinder 41 while being bent like U shape, then being guided outward from the weft yarn storing cylinder 41 while being kept in contact with the outlet guide 45*b* at the side of yarn leading-out.

The weft yarn Twf led-out from the weft yarn storing cylinder 41 is guided by a horizontal guide roller 51, a vertical guide roller 52 and a horizontal guide roller 53, being introduced into a plate spring tension device 60.

In the invention, the weft yarn Twf is laterally unwound at a constant speed from the weft yarn bobbin 10. Therefore, even if there is adhesion between yarns wound on the weft yarn bobbin 10 caused by a sizing agent imparted on the yarn, the adhesion can be easily removed, since the weft yarn is unwound in the direction almost perpendicular to the axis of the weft yarn bobbin 10. As a result, it can be prevented that the weft yarn Twf is fluffed or broken. Furthermore, unlike the longitudinal unwinding, it does not happen that one twist is imparted at a length of yarn corresponding to one turn around a bobbin. Therefore, in the case where the weft yarn Twf is a flat yarn, the yarn width is stably maintained.

The weft yarn Twf unwound from the weft yarn bobbin 10 runs in contact with the tension roller 32 usually positioned above, and proceeds to the nip rollers 31. If the loom stops, the tension roller 32 automatically declines even if the bobbin 10 revolves by inertia. With this constitution, a state that a tension acts on the weft yarn Twf is constantly maintained and occurrence of twist in the weft yarn Twf is prevented.

The weft yarn Twf that has passed the constant speed unwinding mechanism comprising the take-up roller 31*a* and the nip roller 31*b* is sucked into the weft yarn storing cylinder 41. With this constitution, even if the loom is operated at a high speed, a certain length of the weft yarn Twf can be continuously supplied into the weft yarn storing cylinder 41 at a constant speed. For this reason, it can be prevented that the weft yarn Twf is loosened in the weft yarn feeding passage YPwf, and a tension for leading-in the weft yarn into the weft yarn storing cylinder 41 is also kept stable.

In the conventional yarn unwinding method based on an on-off control of rotation of motor, since a feeding speed becomes discontinuous in high speed operation, a tension variation of a weft yarn becomes large, and the weft yarn is loosened and twisted before it reaches a weft yarn storing means due to an overrun of the weft yarn at starting time. However, such matters do not happen in the invention for the reasons as described above.

When the weft yarn Twf is intermittently inserted by means of the rapier 21, it can happen that the weft yarn Twf is loosened due to inertia at the moment when the insertion is completed. However, since the weft yarn Twf is stored in the weft yarn storing cylinder 41 by means of air suction of the weft yarn storing cylinder 41, the weft yarn Twf can be incessantly kept tensioned.

Unless the weft yarn Twf is kept tensioned by means of air suction, the weft yarn can be twisted when it is loosened. If the weft yarn is once twisted, there occurs a problem that the weft yarn Twf, as twisted, passes along the horizontal guide roller 51, the vertical guide roller 52 and the horizontal guide roller 53, and is woven with the warp yarns Twr in the weaving means 20.

The weft yarn gate 42 of the weft yarn storing cylinder 41 can also be opened only at the sides of weft yarn Twf leading-in and leading-out, and closed in the intermediate portion. However, in this case, air introduced through the weft yarn gate 42 is suddenly diffused in the weft yarn storing cylinder 41 and disturbance of air flow is occurred, and the weft yarn Twf is likely to be twisted.

Therefore, it is preferred that a cross sectional figure of the weft yarn gate 42 is almost the same as a cross sectional figure of the weft yarn storing cylinder 41, and that the weft yarn gate 42 is fully opened. In this case, air flow in the weft yarn storing cylinder 41 is kept in a state of laminar flow and swirling of the weft yarn Twf can be prevented, and imparting of false-twisting to the weft yarn Twf is also prevented. Especially in the case where the weft yarn Twf is a flat yarn, it is easy to maintain the flat state.

In high speed operation, it may happen that since the running speed of the weft yarn Twf in the weft yarn feeding passage YPwf is high, the weft yarn Twf comes off from the weft yarn gate 42 and cannot be stored in the weft yarn storing cylinder 41 any more.

To prevent it, it is desirable to install a stopper pin (not shown in the drawings) in parallel with the inlet guide 45*a* and the outlet guide 45*b* at a position of about 1 to about 10 cm from the weft yarn gate 42 toward the air releasing port 43.

In the case where the stopper pin is fixed, when the weft yarn Twf is passed along the weft yarn feeding passage YPwf, the tip of the weft yarn Twf is introduced from the inlet guide 45*a* into the weft yarn storing cylinder 41, and passed behind the stopper pin, being guided toward the outlet guide 45*b*. In the case where the stopper pin is detachable, the stopper pin is lo inserted from the outside of the weft yarn Twf positioned along the weft yarn gate 42.

In the case where the weft yarn Twf is a flat yarn, if the weft yarn Twf is stored in U shape in the weft yarn storing cylinder 41, air collides with the weft yarn Twf at the turn of the weft yarn Twf, and air streams flowing from the center toward the edges in the yarn width give effects of opening the weft yarn Twf and widening the yarn width.

The potential curls of the weft yarn Twf caused by a deposited bundling agent and by winding around the bobbin are also removed by a function of opening which is brought by air colliding to the weft yarn Twf. An irregularity in the yarn width of the weft yarn Twf caused due to an influence of yarn twisting attributable to potential curls can also be kept small.

Since the weft yarn Twf is stored in the weft yarn storing cylinder 41 in a state of small load by incessant air suction, variation of tension of the weft yarn Twf is little. Damages of the weft yarn Twf caused by occurrence of an abnormal tension is also little. Because of air suction, a tension for storing the weft yarn Twf is small, and it becomes possible to insert the weft yarn Twf at a high speed in the weaving means 20.

As for the peripheral form of the weft yarn gate 42 of the weft yarn storing cylinder 41, the weft yarn gate 42 has at least a first side 42*a* and a second side 42*b* parallel to each other, and the inlet guide 45*a* at the side of yarn leading-in to be kept in contact with the weft yarn Twf running from the weft yarn bobbin 10 into the weft yarn storing cylinder 41 is provided along the first side 42*a*, while the outlet guide 45*b* at the side of yarn leading-out to be kept in contact with the weft yarn Twf running from inside the weft yarn storing cylinder 41 toward the weaving means 20 is provided along the second side 42*b*.

With this constitution, the lead-in of the weft yarn Twf into the weft yarn storing cylinder 41 and the lead-out of the weft yarn Twf from the weft yarn storing cylinder 41 are guided by means of the inlet guide 45*a* at the side of yarn leading-in and the outlet guide 45*b* at the side of yarn leading-out facing each other in parallel, and in the weft yarn storing cylinder 41, the weft yarn Twf is returned in U shape while being kept in contact with a wall surface in the weft yarn storing cylinder 41. Therefore, the weft yarn Twf in the weft yarn storing cylinder 41 can be prevented from being twisted. Especially, in the case where the weft yarn Twf is a flat yarn, the flat state of the weft yarn can be maintained in the weft yarn storing cylinder 41.

Here, the width direction of the weft yarn Twf refers to the direction of the longest one of given straight lines drawn in the cross section of the yarn bundle.

It is preferred that the first side 42*a* and the second side 42*b* parallel to each other are straight. Parallel includes a state of virtually parallel. The inlet guide 45*a* at the side of yarn leading-in and the outlet guide 45*b* at the side of yarn leading-out can have respectively slight projections or a slight gradient for reducing frictional resistance against the weft yarn Twf.

The weft contact means in the weft yarn storing cylinder 41 can also be the inner wall surface of the weft yarn storing cylinder 41 per se, but it is preferred that the weft contact means located in the weft yarn storing cylinder 41 comprises an guide at the side of yarn leading-in to be kept in contact with the weft yarn Twf leading-in from the inlet guide 45*a* at the side of yarn leading-in and an guide at the side of yarn leading-out to be kept in contact with the weft yarn Twf leading-out from the outlet guide 45*b* at the side of yarn leading-out, and that the distance L between the guide at the side of yarn leading-in and the guide at the side of yarn leading-out in the direction perpendicular to the direction of the inlet guide 45*a* at the side of yarn leading-in (the guide at the side of yarn leading-out) gradually decreases from the weft yarn gate 42 toward the air releasing port 43.

For keeping the weft yarn Twf stably stored in the weft yarn storing cylinder 41 when the loom is operated at a high speed, the suction force of the blower connected with the suction hose 44 must be increased. In this case, the radius of curvature of the U shape formed by the weft yarn Twf in the weft yarn storing cylinder 41 becomes smaller, and the weft yarn Twf less contacts the inner wall surface of the weft yarn storing cylinder 41 per se. As a result, the weft yarn Twf floats in the air inside the weft yarn storing cylinder 41 and is likely to be twisted due to the disturbance of air stream or the like. Especially, in the case where the weft yarn Twf is a flat yarn, there is a case that this phenomenon could obstruct maintenance of a flat state of the flat yarn.

To prevent the phenomenon, it is desirable that, in the weft yarn storing cylinder 41, a plane including the guide at the side of yarn leading-in and a plane including the guide at the side of yarn leading-out are inclined in such a manner that the distance L between the guide at the side of yarn leading-in and the guide at the side of yarn leading-out in the direction perpendicular to the direction of the inlet guide 45*a* at the side of yarn leading-in (the outlet guide 45*b* at the side of yarn leading-out) gradually decreases from the weft yarn gate 42 toward the air releasing port 43. With this constitution, a stable yarn passage of the weft yarn Twf in the weft yarn storing cylinder 41 can be reliably formed, and the twisting of the weft yarn Twf in the weft yarn storing cylinder 41 can be prevented or decreased.

As for an inclination angle of each of the planes including the guide at the side of yarn leading-in and including the guide at the side of yarn leading-out, the inclination of the plane can be decided in reference to a stored condition of the weft yarn Twf in the weft yarn storing cylinder 41, to ensure that the weft yarn Twf contacts the guide surfaces, but usually it is preferred that a gradient is in a range from 0.5/100 to 10/100.

It is only required that a length of the weft yarn storing cylinder 41 is at least ½ or more of a length of the weft yarn inserted by the rapier 21, since a sucked weft yarn Twf is returned in the weft yarn storing cylinder 41. It is usually desirable that the length of the weft yarn storing cylinder 41 is about [(½ of the length of the weft yarn inserted)+(10 to 40)] (in cm). For example, if the length of the weft yarn inserted is 1.1 m in a woven fabric F having a width of 1 m, the length of the weft yarn storing cylinder 41 is about 65 to about 95 cm.

In this example, the length of the weft yarn storing cylinder 41 is employed when the stored length of the weft yarn Twf corresponds to the length of the weft yarn inserted per time, but it is not necessarily limited to this case. The weft yarn Twf in a length corresponding to a length necessary for twice insertion of the weft yarn can also be stored.

Storing the weft yarn having a volume necessary for one-time insertion of the weft yarn in the weft yarn storing cylinder 41, means storing the weft yarn having a length necessary for at least one-time insertion of the weft yarn. However, the insertion of the weft yarn is started by means of the rapier 21 while the weft yarn Twf unwound from the weft yarn bobbin 10 at a constant speed is sucked into the weft yarn storing cylinder 41. So, the largest volume of the weft yarn stored in the weft yarn storing cylinder 41 is not necessarily equal to a volume of the weft yarn necessary for one-time insertion of the weft yarn. It is preferred, for example, that in the case where a length of the weft yarn inserted by means of the rapier 21 is 1.1 m, a length of the weft yarn Twf stored in the weft yarn storing cylinder 41 is about 65 to about 95 cm.

Furthermore, there can be a case where a volume of the weft yarn stored in the weft yarn storing cylinder 41 immediately after completion of insertion of the weft yarn by means of the rapier 21 is substantially 0. However, to facilitate the introduction of the weft yarn Twf into the weft yarn storing cylinder 41, it is preferred that the weft yarn Twf remains sucked by about 1 to about 10 cm in the weft yarn storing cylinder 41.

It is preferred that the plane including the guide at the side of yarn leading-in and the plane including the guide at the side of yarn leading-out are respectively formed of an air permeable sheet or a plurality of parallel rods spaced apart each other. Examples of the guide at the side of yarn leading-in and the guide at the side of yarn leading-out are explained in reference to FIGS. 4 and 5.

Figure 4:
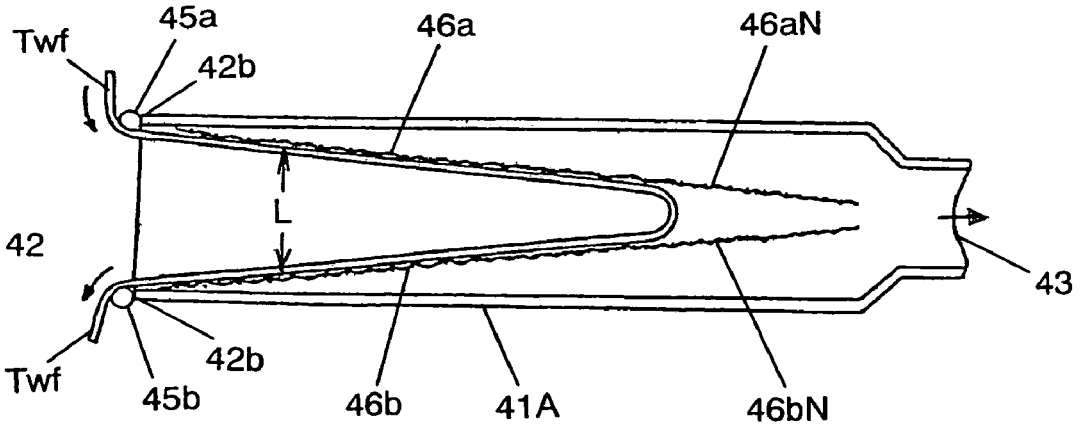
FIG. 4 is a longitudinal sectional view showing another embodiment of the weft yarn storing cylinder shown in FIG. 3.

FIG. 4 is a longitudinal sectional view showing a weft yarn storing cylinder 41A as another embodiment of the weft yarn storing cylinder 41 shown in FIG. 3.

In FIG. 4, the weft yarn storing cylinder 41A has the weft yarn gate 42 at one end thereof and the air releasing port 43 at the other end thereof. The weft yarn gate 42 has the first side 42*a*, the inlet guide 45*a* at the side of yarn leading-in, the second side 42*b* and the outlet guide 45*b* at the side of yarn leading-out like the weft yarn storing cylinder 41 of FIG. 3.

The weft yarn storing cylinder 41A is provided with a guide 46*a* at the side of yarn leading-in to be kept in contact with the weft yarn Twf leading-in from the inlet guide 45*a* at the side of yarn leading-in and a guide 46*b* at the side of yarn leading-out to be kept in contact with the weft yarn Twf leading-out from the outlet guide 45*b* at the side of yarn leading-out. The distance L between the guide 46*a* at the side of yarn leading-in and the guide 46*b* at the side of yarn leading-out in the direction perpendicular to the direction of the inlet guide 45*a* at the side of yarn leading-in (the outlet guide 45*b* at the side of yarn leading-out) gradually decreases from the weft yarn gate 42 toward the air releasing port 43.

A cross sectional figure of the weft yarn storing cylinder 41A remains substantially the same in the direction from the weft yarn gate 42 to the air releasing port 43. The guide 46*a* at the side of yarn leading-in and the guide 46*b* at the side of yarn leading-out respectively comprises a net 46*a*N and a net 46*b*N facing each other. The distance L between the net 46*a*N and the net 46*b*N in the direction perpendicular to the inlet guide 45*a* at the side of yarn leading-in (the outlet guide 45*b* at the side of yarn leading-out) gradually decreases from the weft yarn gate 42 toward the air releasing port 43.

The weft yarn Twf leading-in though the inlet guide 45*a* at the side of yarn leading-in into the weft yarn storing cylinder 41A runs in contact with the net 46*a*N and forms an inward yarn passage. The weft yarn Twf leading-out through the outlet guide 45*b* at the side of yarn leading-out from the weft yarn storing cylinder 41A runs in contact with the net 46*b*N and forms an outward yarn passage.

Installing the two nets 46*a*N, 46*b*N having inclination in the weft yarn storing cylinder 41A having the same cross sectional figures throughout it, most of air sucked in the weft yarn storing cylinder 41A flows between the net 46*a*N and the net 46*b*N, and the remaining air sucked passes through the net 46*a*N and the net 46*b*N outward.

Therefore, owing to the air stream between the net 46*a*N and the net 46*b*N, the weft yarn Twf is sucked in U shape in the weft yarn storing cylinder 41A. Furthermore, owing to the air streams flowing through the net 46*a*N and the net 46*b*N outward, the weft yarn Twf is sucked toward the net 46*a*N and the net 46*b*N. As a result, the weft yarn Twf is reliably kept in contact with the net 46*a*N and the net 46*b*N when stored in the weft yarn storing cylinder 41A. The phenomenon that the weft yarn Twf stored in U shape in the weft yarn storing cylinder 41 floats in air in the weft yarn storing cylinder 41A and is twisted due to the disturbance of the air streams or the like is prevented. This method is especially preferred in the case where the weft yarn Twf is a flat yarn, since a flat state of the flat yarn can be stably maintained.

As the air permeable sheet that can be used for forming the nets 46*a*N and 46*b*N, for example, a wire net, plastic net or punched metal can be used. A percentage of void of the air permeable sheet can be expressed by the ratio of the air permeable area to the total area of the sheet, i.e. [(Air permeable area)/(Total area of sheet)]. It is preferred that the percentage of void is 10% or more, and that the largest width of each void portion is 3 mm or less.

If the percentage of void is less than 10% and if the largest width of each void portion is more than 3 mm, a volume of air passing through the air permeable sheet decreases, and the weft yarn Twf floats in air in the weft yarn storing cylinder 41A and is likely to be twisted due to the disturbance of the air streams, etc. Furthermore, the weft yarn Twf is likely to be sucked into void portions to cause abrasive fluffing.

The respective inclination angles of the nets 46*a*N and 46*b*N are selected in reference to a stored state of the weft yarn Twf in the weft yarn storing cylinder 41A, to ensure that the weft yarn Twf contacts the nets 46*a*N and 46*b*N. If the inclination angle is too large, a flow velocity of air sucked in the weft yarn storing cylinder 41 changes greatly to destabilize the stored state of weft yarn Twf. So, it is preferred that the gradient is kept as small as 0.5/100 to 10/100.

Figure 5:
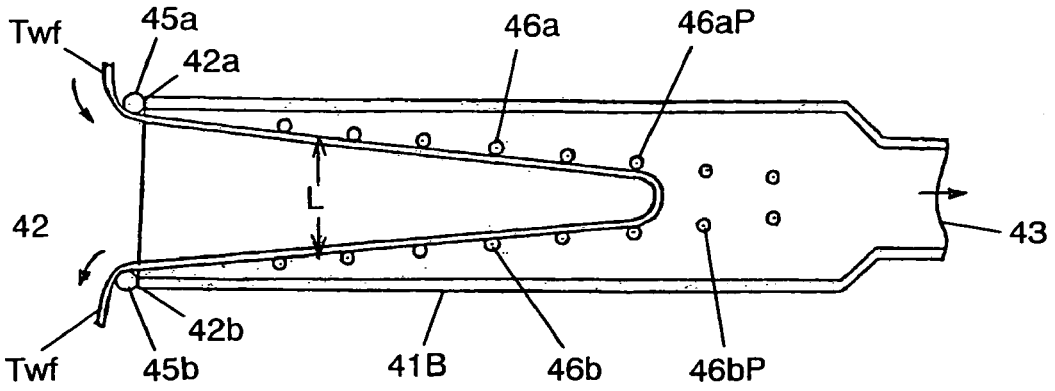
FIG. 5 is a longitudinal sectional view showing a further other embodiment of the weft yarn storing cylinder shown in FIG. 3.

FIG. 5 is a longitudinal sectional view of a weft yarn storing cylinder 41B as still another embodiment of the weft yarn storing cylinder 41 shown in FIG. 3.

In FIG. 5, the weft yarn storing cylinder 41B has the weft yarn gate 42 at one end thereof and the air releasing port 43 at the other end thereof. The weft yarn gate 42 has the first side 42*a*, the inlet guide 45*a* at the side of yarn leading-in, the second side 42*b* and the outlet guide 45*b* at the side of yarn leading-out like the weft yarn storing cylinder 41 of FIG. 3.

The weft yarn storing cylinder 41B is provided with the guide 46*a* at the side of yarn leading-in to be kept in contact with the weft yarn Twf leading-in from the inlet guide 45*a* at the side of yarn leading-in and the guide 46*b* at the side of yarn leading-out to be kept in contact with the weft yarn Twf leading-out from the outlet guide 45*b* at the side of yarn leading-out. The distance L between the guide 46*a* at the side of yarn leading-in and the guide 46*b* at the side of yarn leading-out in the direction perpendicular to the inlet guide 45*a* at the side of yarn leading-in (the outlet guide 45*b* at the side of yarn leading-out) gradually decreases from the weft yarn gate 42 toward the air releasing port 43.

A cross sectional figure of the weft yarn storing cylinder 41B remains substantially the same in the direction from the weft yarn gate 42 to the air releasing port 43. The guide 46*a* at the side of yarn leading-in and the guide 46*b* at the side of yarn leading-out respectively comprises a plurality of parallel pins 46*a*P and a plurality of parallel pins 46*b*P. The distance between a plane including the pins 46*a*P and a plane including the pins 46*b*P in the direction perpendicular to the direction of the inlet guide 45*a* at the side of yarn leading-in (the outlet guide 45*b* at the side of yarn leading-out) gradually decreases from the weft yarn gate 42 toward the air releasing port 43.

The weft yarn Twf leading-in through the inlet guide 45*a* at the side of yarn leading-in into the weft yarn storing cylinder 41B runs in contact with the pins 46*a*P and forms an inward yarn passage. The weft yarn Twf leading-out through the outlet guide 45*b* at the side of yarn leading-in from the weft yarn storing cylinder 41B runs in contact with the pins 46*b*P and forms an outward yarn passage.

Installing the two planes respectively including the pins 46*a*P and the pins 46*b*P, having inclination in the weft yarn storing cylinder 41B having the same cross sectional figures throughout it, air stream formed between the plane including the pins 46*a*P and the plane including the pins 46*b*P sucks the weft yarn Twf in U shape in the weft yarn storing cylinder 41B as in the weft yarn storing cylinder 41A of FIG. 4. Furthermore, the air streams that flow between the pins 46*a*P outward and flow between the pins 46*b*P outward suck the weft yarn Twf toward the plane including the pins 46*a*P and the plane including the pins 46*b*P.

As a result, the weft yarn Twf is reliably kept in contact with the pins 46*a*P and the pins 46*b*P when stored in the weft yarn storing cylinder 41B. The phenomenon that the weft yarn Twf stored in U shape in the weft yarn storing cylinder 41B floats in air in the weft yarn storing cylinder 41B and is twisted due to the disturbance of the air streams or the like is prevented. This method is especially preferred in the case where the weft yarn Twf is a flat yarn, since the flat state of the flat yarn can be stably maintained.

It is preferable that the pins 46*a*P and 46*b*P used in this case have a diameter of 2 to 10 mm and are arranged with a space of 3 to 30 mm. In the case where the diameter of the pin is less than 2 mm, or in the case where the space between the pins is more than 30 mm, there arise such problems that the air streams flowing between pins may cause the weft yarn Twf to be caught between the pins, and that fluff is collected around the pins. Furthermore, in the case where the diameter of the pin is more than 10 mm or in the case where the space between the pins is less than 3 mm, an area occupied by the pins in the weft yarn storing cylinder 41B becomes so large that the air streams passing between the pins decrease, causing the stored weft yarn Twf to leave from the pins and making the weft yarn Twf likely to be twisted.

The space between the pins can be changed adequately depending on a kind of the weft yarn used, within the range of amount of the space explained above. For example in the case of carbon fibers, if a deposited amount of a sizing agent is 0.5% or less, it is preferred that the space between the respectively adjacent pins is in a range from 2 to 15 mm, and if a deposited amount of a sizing agent is more than 0.5%, it is preferred that the space is in a range from 10 to 30 mm.

In the case where the weft yarn is a soft yarn having a deposited amount of a sizing agent of 0.5% or less, if the space between the respectively adjacent pins is made larger than 15 mm, there occurs a problem that since the flexural rigidity of the yarn is small, the weft yarn Twf is likely to be sucked into the gaps between the pins and wound around the pins because of the air streams passing between the pins. On the other hand, if the space between the respectively adjacent pins is less than 2 mm, since the air streams passing between the pins are small in volume, it is difficult to keep the weft yarn Twf in stable contact with the pins, when the yarn is stored.

Moreover, a yarn having more than 0.5% of a sizing agent deposited has strong potential curls, and in the case where such a yarn is handled, if the space between pins is kept as large as 10 to 30 mm for increasing the air streams passing between the pins, to keep the weft yarn Twf in strong contact with the pins, the weft yarn Twf can be preferably prevented from being twisted. However, even if the flexural rigidity of the yarn becomes large, if the space between the respectively adjacent pins is larger than 30 mm, there may occur such a problem that the air streams passing between the pins cause the weft yarn Twf to be sucked into the gaps between the pins.

Furthermore, it is preferred that the surface of the pin is treated with a fluorine resin or sattin-finished, for reducing contact resistance with the reinforcing fiber yarn.

With regard to the respective inclination angles of the plane including the pins 46*a*P and the plane including the pins 46*b*P, it is only required to decide the inclinations of the pin-including planes in reference to a state of the weft yarn Twf stored in the weft yarn storing cylinder 41B, to ensure that the weft yarn Twf contacts the respective pins. If the inclination angle is too large, a flow velocity of air sucked in the weft yarn storing cylinder 41B changes greatly to destabilize the state of the stored weft yarn Twf. It is usually preferred that the inclination angle is such as to keep a gradient as small as about 0.5/100 to about 10/100.

A figure of the weft yarn gate 42 in FIGS. 3, 4 and 5 is not especially limited, if the first side 42*a* where the leading-in weft yarn Twf is located and the second side 42*b* where the leading-out weft yarn Twf is located are substantially straight respectively and parallel to each other. For example, the respective both ends of the straight sides 42*a* and 42*b* parallel to each other can be connected through circular arcs, or the weft yarn gate 42 can also be a trapezoid formed by connecting the respective both ends by means of straight lines.

That is, if the portions to be kept in contact with the weft yarn Twf in the weft yarn storing cylinder 41, 41A or 41B including the weft yarn gate 42, 41A or 41B are straight respectively and parallel to each other, occurrence of twisting on the weft yarn Twf can be prevented, since the weft yarn Twf runs in contact with the straight portions at leading-in the weft yarn Twf into the weft yarn storing cylinder 41, 41A or 41B, at leading-out the weft yarn Twf from the weft yarn storing cylinder 41, 41A or 41B and at storing the weft yarn Twf in the weft yarn storing cylinder 41, 41A or 41B.

It is preferred that a cross sectional figure of the weft yarn storing cylinder 41, 41A or 41B is rectangular, and that the weft yarn Twf is led-in along one of the short sides of the rectangle and is led-out along the other short side. With this constitution, most of air sucked into the weft yarn storing cylinder can be allowed to collide with the turned portion of the weft yarn Twf, and a capacity of the blower can be exhibited effectively.

Moreover, since the distance between the weft yarn leading-in portion and the weft yarn leading-out portion can be kept large, the weft yarn Twf can be turned under a large curvature in the weft yarn storing cylinder. So, the damage of the weft yarn Twf can be kept small.

It is preferred that a length of the short sides of the rectangle is in a range from 10 to 40 mm, for reducing the variation in the yarn width while the weft yarn is stored. If the length of the short sides is less than 10 mm, the yarn width becomes narrow, when the weft yarn feeding position changes while it is stored. If the length of the short sides is more than 40 mm, an opening area of the weft yarn gate 42 becomes large, and a capacity of the blower must be increased. It is preferred that a length of the long sides of the rectangle is in a range from 40 to 100 mm.

It is preferred that an air suction rate in the weft yarn storing cylinder 41, 41A or 41B is in a range from 0.05 to 100 $m^3$/min. If the suction rate is less than 0.05 $m^3$/min, the suction rate is too small to allow the weft yarn Twf to be stored stably, and the weft yarn Twf is twisted. On the other hand, if the suction rate is more than 100 $m^3$/min, the suction rate is so large that the weft yarn Twf stored in the weft yarn storing cylinder is shaken and twisted, or since the fibers constituting the weft yarn Twf are disturbed, fluffing is likely to occur. It is more preferred that the suction rate is in a range from 0.1 to 50 $m^3$/min. If the speed of the loom is raised, the running speed of the weft yarn Twf in the weft yarn storing cylinder becomes higher. So, for stably storing the weft yarn Twf, it is preferred that the suction rate is higher. Here, a suction rate refers to a flow rate of air at the weft yarn gate 42.

It is preferred that the inlet guide 45*a* at the side of yarn leading-in and the outlet guide 45*b* at the side of yarn leading-out, i.e., yarn passage guides are provided along the yarn leading-in side 42*a* and the yarn leading-out side 42*b* of the weft yarn gate 42. It is preferred that these yarn passage guides are ceramic. With this constitution, the yarn passages of the weft yarn Twf can be stabilized, and the fluffing of the weft yarn Twf due to abrasion during yarn running can be reduced.

As another method for keeping the weft yarn Twf in tension state, a mechanical storing means such as an eccentric cam provided in the weft yarn feeding passage YPwf can be used together with the storing by means of air suction. With this constitution, a part of a volume of the yarn that must be stored can be stored in mechanical, and the remaining part can be stored in the weft yarn storing cylinder by means of air suction. In this case, a volume of the weft yarn Twf sucked into the weft yarn storing cylinder can be reduced, and a length of the weft yarn storing cylinder can be shortened to allow the apparatus installation space to be reduced.

When the weft yarn storing cylinder is used for storing the weft yarn Twf, an air jet can also be used together. In adaptation to the movement of the rapier 21 for inserting the weft yarn, when the length of the stored weft yarn Twf becomes the shortest, air can be injected momentarily from outside the weft yarn gate 42 for pressing the weft yarn Twf into the weft yarn storing cylinder, to facilitate the sucking of the weft yarn Twf into the weft yarn storing cylinder.

It is preferred that a tenser for imparting a tension to the weft yarn Twf is provided at the leading-out portion of the weft yarn Twf in the weft yarn storing cylinder. It can happen that when the weft yarn is inserted, the weft yarn Twf stored in the weft yarn storing cylinder is suddenly drawn out, and that when the weft insertion has been completed, the weft yarn Twf is loosened due to inertia in the passage between the weft yarn storing cylinder and the yarn feed portion of the rapier, causing a problem that the weft yarn Twf is twisted. This problem can be solved if the tenser is installed to keep the weft yarn Twf tensioned. Especially, when the weft yarn Twf is a flat yarn, the tenser can give an effect of stably maintaining the flat state.

The method for feeding the weft yarn Twf stored in the weft yarn storing cylinder to the rapier 21 is explained.

The guide rollers 50 include the horizontal guide roller 51, the vertical guide roller 52 and the horizontal guide roller 53. As each of the guide rollers, a driven rotary roller having a diameter of about 10 to about 20 mm and a length of about 100 mm to about 300 mm and containing a bearing can be preferably used.

If the diameter is too small, the weft yarn Twf is bent, and numerous filaments constituting the yarn are likely to be broken. If the diameter is more than 20 mm, the inertia of revolution becomes large, and there occurs a problem that when the loom is started or stopped, the tension of the weft yarn Twf changes greatly.

It is preferred that the length of each guide roller is such that when the weft yarn Twf passing along the roller moves horizontally or vertically, it does not contact a support portion supporting the guide roller. If the weft yarn Twf contacts a support portion of each guide roller, the figure, especially the flat figure of the weft yarn Twf may be impaired.

The horizontal guide rollers 51 and 53 decide the position of the guided weft yarn Twf in the vertical direction, and the vertical guide roller 52 decides the position of the weft yarn Twf in the horizontal direction. Therefore, as the guide rollers 50, it is preferred that the guide rollers at least in the horizontal direction and in the vertical direction are arranged alternately.

Between the horizontal guide roller 51 and the vertical guide roller 52 and between the vertical guide roller 52 and the horizontal guide roller 53, the weft yarn Twf is twisted 90° in the yarn width direction. Therefore, it is preferred to keep a distance of 50 mm or more, though depending on the yarn width of the weft yarn Twf, between the horizontal guide roller 51 and the vertical guide roller 52 and between the vertical guide roller 52 and the horizontal guide roller 53. If the distance is less than 50 mm, it can happen that the weft yarn Twf, as twisted, may be fed along the vertical guide roller 52 or the horizontal guide roller 53, to be woven into the fabric. Furthermore, if a flat yarn is twisted 90° in a short distance, a tension can act on both the edges of the flat yarn, and fluffing is likely to occur.

Each of the guide rollers can also be one guide roller. However, if a pair of two guide rollers are used instead of each guide roller so that the weft yarn Twf passes along the two guide rollers in an S-shaped manner, the tension acting on the weft yarn Twf is stabilized, and the weft yarn Twf can be stably positioned on each guide roller.

The plate spring tension device 60 is disposed downstream of the horizontal guide roller 53 for keeping the weft yarn Twf tensioned uniformly. The plate spring tension device 60 comprises two wide plate springs 60*a* and 60*b*, and the weft yarn Twf is held between them so that it can be kept tensioned uniformly.

When the weft yarn Twf is fed, in principle, the vertical guide roller 52 decides the yarn passage of the weft yarn Twf, but with the change in the tension of the weft yarn Twf and with the action of getting the weft yarn Twf hooked by the rapier 21, it can happen that the yarn passage of the weft yarn Twf changes. Therefore, it is preferred that the weft yarn feeding passage YPwf is free from any obstacle likely to interfere with the ends of the weft yarn Twf even if the weft yarn Twf moves in the width direction, and for this reason, the plate spring tension device 60 comprising the wide plate springs 60*a* and 60*b* is used. It is preferred that the width of the plate springs 60*a* and 60*b* is more than 5 times of the yarn width of the weft yarn Twf.

The push plate guide 70 is disposed downstream of the plate spring tension device 60, and is formed of a plate with a V-shaped guide face 70*a* formed at its tip. The push plate guide 70 is interlocked with the feed of the weft yarn Twf into the rapier 21 and is driven in the longitudinal direction indicated by arrow 70*b*, using the cam mechanism to which the revolution of the loom is transmitted.

Furthermore, if a yarn feed guide is used when the weft yarn Twf is fed into the rapier 21, in the case where the weft yarn Twf is a flat yarn, it can happen that the guide hole of the yarn feed guide abrades the weft yarn Twf, to crush the flat form. To prevent it, it is preferred that the push plate guide 70 is installed between the plate spring tension device 60 and a yarn end holding guide (not shown in the drawings), so that when the weft yarn Twf is fed into the rapier 21, the yarn end holding guide is lowered while the push plate guide 70 is advanced to press the weft yarn Twf to the rear of the loom, for letting the weft yarn traverse across the rapier 21.

The rapier 21 is a longitudinal member disposed in front of the reed 22, and acts intermittently in the transverse direction, for inserting the weft yarn Twf between the warp yarns Twr and Twr in the weaving section.

The horizontal guide roller 51, the vertical guide roller 52, the horizontal guide roller 53, the plate spring tension device 60, the push plate guide 70, the rapier 21 and the weaving means 20 are described in detail in JP-10-331056-A1 or EP-0737765-A2.

In the apparatus shown in FIGS. 1 to 3, the weft yarn Twf wound around the weft yarn bobbin 10 is unwound at a constant speed by means of the nip rollers 31, and the loosening caused when the weft yarn is intermittently inserted by means of the rapier 21 is sucked by air suction into the weft yarn storing cylinder 41. The weft yarn Twf unwound from the weft yarn bobbin 10 is guided by means of the horizontal guide roller 51, the vertical guide roller 52 and the horizontal guide roller 53, and is uniformly kept tensioned by means of the plate spring tension device 60, while it is hooked on the claw of the rapier 21 under the cooperative action of the push plate guide 70 and the yarn end holding guide, then to be inserted between the warp yarns Twr, Twr in the weaving section. As a result, especially in the case where the weft yarn Twf is a flat yarn, it can be inserted without being tensioned or without being crushed in flat form.

On the other hand, the warp yarns Twr are laterally unwound from warp bobbins (not shown in the drawings). In the case where the warp yarns Twr are flat yarns, they are introduced into the weaving means 20 with their flat state maintained, and woven with the inserted weft yarns Twf. As a result, the reinforcing fiber woven fabric F is produced. In the case where the warp yarns Twr and the weft yarns Twf are flat yarns, a reinforcing fiber woven fabric F composed of flat yarns can be produced.

It is preferred that the speed of the loom is in a range from 100 to 400 rpm. If the speed is less than 100 rpm, the production speed declines to lower the production efficiency. On the other hand, if the speed is more than 400 rpm, the fluffing of the weaving yarns increases and the weft yarns are likely to be broken because of high-speed operation. Especially, in the case where the weaving yarns are flat yarns, a woven fabric can be produced with the flat state maintained without causing the weft yarns to be twisted.

Figure 6:
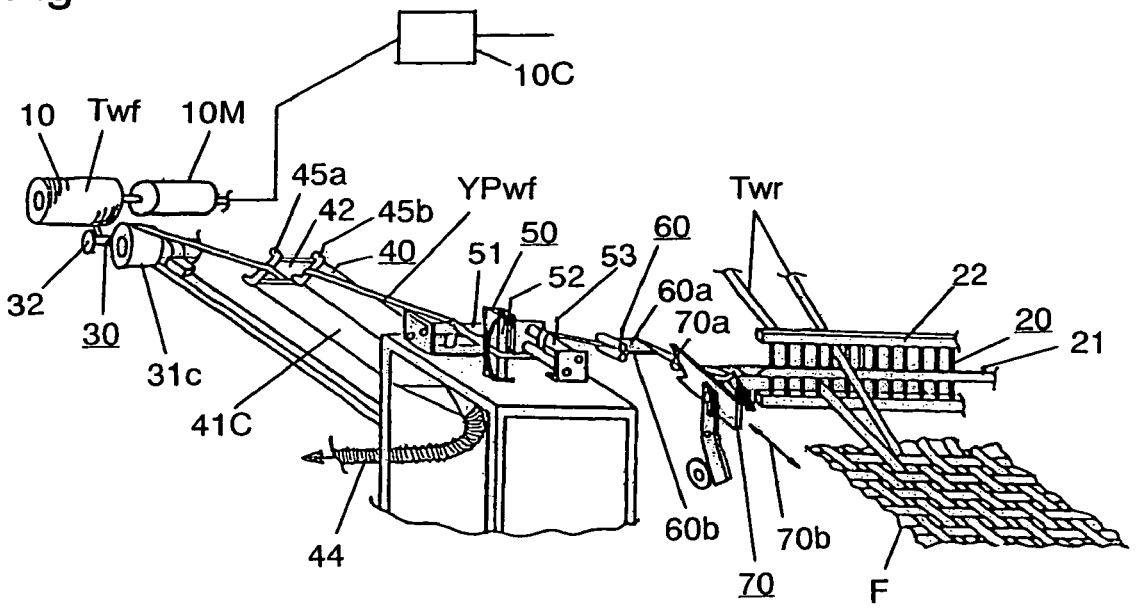
FIG. 6 is a perspective schematic front view showing another embodiment of the apparatus for carrying out the method for producing a reinforcing fiber woven fabric of the invention.

Another example of the apparatus for carrying out the method for producing a reinforcing fiber woven fabric of the invention is shown in FIG. 6. The detail of the weft yarn unwinding means of the apparatus is shown in FIG. 7, and the detail of the weft yarn storing means of the apparatus is shown in FIG. 8.

Figure 7:
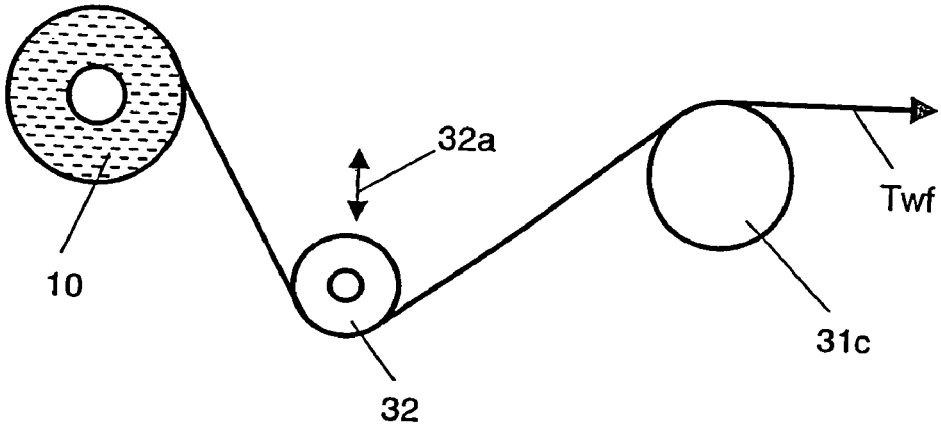
FIG. 7 is a schematic side view showing a weft yarn unwinding means in the apparatus shown in FIG. 6.
Figure 8:
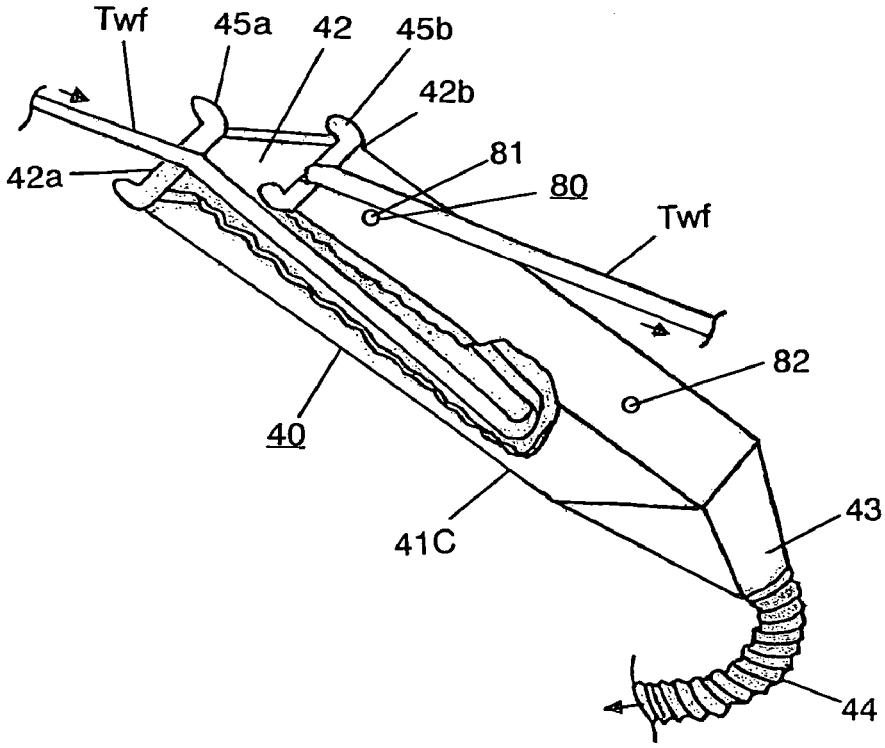
FIG. 8 is a partially sectional perspective view showing a weft yarn storing cylinder in the apparatus shown in FIG. 6.

The component parts common to the apparatus shown in FIGS. 6 to 8 and the apparatus shown in FIGS. 1 to 3 are given the same symbols. The component parts of the apparatus shown in FIGS. 6 to 8 different from those of the apparatus shown in FIGS. 1 to 3 are described below.

In FIGS. 6 to 8, the weft yarn unwinding means 30 comprising a bobbin rotating mechanism (motor) 10M for rotating the weft yarn bobbin 10, a guide roller 31*c* for guiding the weft yarn Twf, a tensioning mechanism (tension roller 32) for incessantly giving a tension to the weft yarn Twf laterally unwound from the weft yarn bobbin 10, in the weft yarn feeding passage YPwf between the weft yarn bobbin 10 and the guide roller 31*c*, and a bobbin rotation control mechanism 10C for controlling the rotation of the motor 10M.

The weft yarn storing means 40 is composed of a weft yarn storing cylinder 41C. The weft yarn storing cylinder 41C has a yarn volume detecting means 80 for detecting a volume of the weft yarn Twf stored in the weft yarn storing cylinder 41C and delivering an output signal corresponding to the detected volume.

The yarn volume detecting means 80 comprises a first sensor 81 located on the side of the weft yarn gate 42 and a second sensor 82 located on the side of the air releasing port 43. The information concerning a volume of the stored yarn detected by either of these sensors 81 and 82 is sent to the bobbin rotation control mechanism 10C, and used for controlling the rotation of the motor 10M.

The structure of the weft yarn storing cylinder 41C shown in FIGS. 6 and 8 is quite the same as the structure of the weft yarn storing cylinder 41 shown in FIGS. 1 and 3, except that the first sensor 81 and the second sensor 82 are provided.

The apparatus shown in FIGS. 6 to 8 and the apparatus shown in FIGS. 1 to 3 have the same constitution, except the differences in the weft yarn unwinding means 30 and the weft yarn storing means 40. The structure and action of the same constitution are not described below to avoid double explanation.

Figure 9:
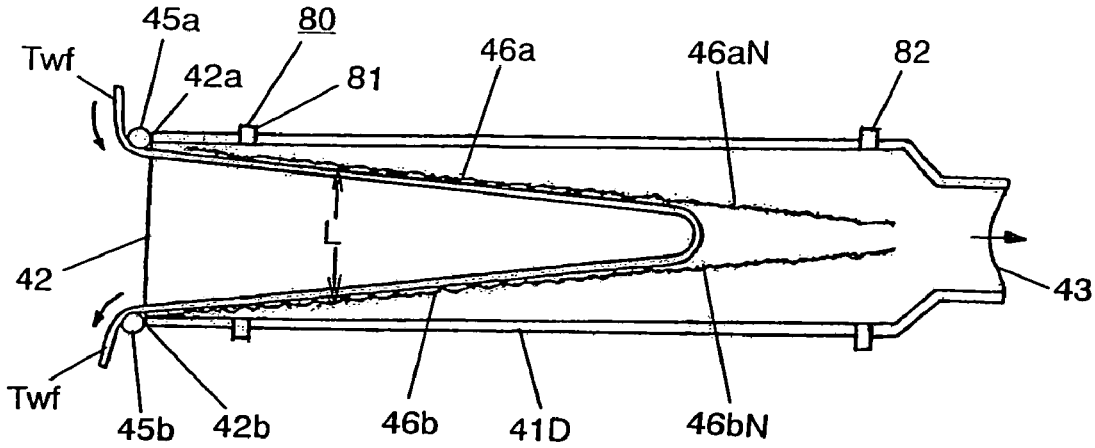
FIG. 9 is a longitudinal sectional view showing another embodiment of the weft yarn storing cylinder shown in FIG. 8.

FIG. 9 is a longitudinal sectional view showing a weft yarn storing cylinder as another embodiment of the weft yarn storing means 40 of the apparatus shown in FIG. 8. In FIG. 9, the weft yarn storing cylinder 41D has the inlet guide 45*a* at the side of yarn leading-in, the outlet guide 45*b* at the side of yarn leading-out, and the guide 46*a* at the side of yarn leading-in formed as the net 46*a*N and the guide 46*b* at the side of yarn leading-out formed as the net 46*b*N facing each other, like the weft yarn storing cylinder 41A shown in FIG. 4. Furthermore, the weft yarn storing cylinder 41D has the yarn volume detecting means 80 for detecting a volume of the weft yarn Twf stored therein and delivering an output signal corresponding to it, like the weft yarn storing cylinder 41C shown in FIG. 8.

The yarn volume detecting means 80 comprises a first sensor 81 located on the side of the weft yarn gate 42 and a second sensor 82 located on the side of the air releasing port 43. The information relating to the volume of the stored weft yarn detected by either of these sensors 81 and 82 is sent to the bobbin rotation control mechanism 10C, to be used for controlling the rotation of the motor 10M.

Figure 10:
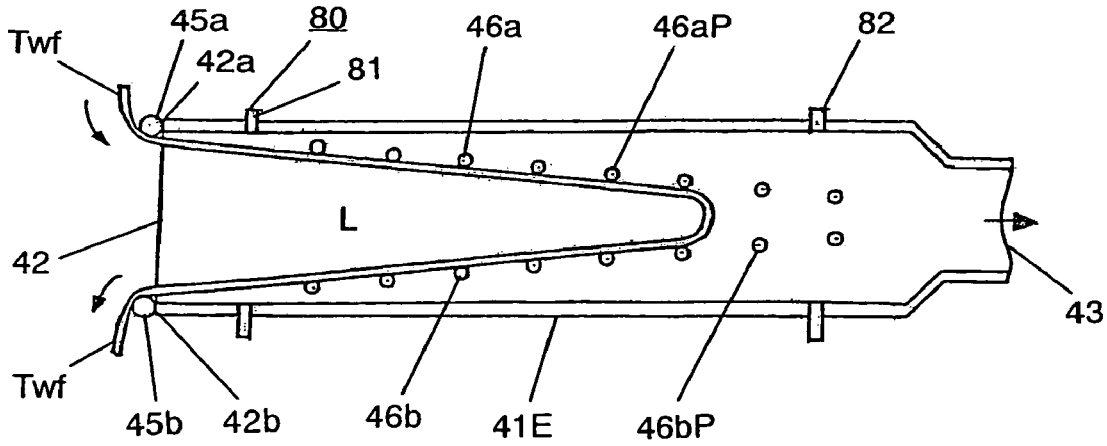
FIG. 10 is a longitudinal sectional view showing a further other embodiment of the weft yarn storing cylinder shown in FIG. 8.

FIG. 10 is a longitudinal sectional view showing a weft yarn storing cylinder 41E as a still another embodiment of the weft yarn storing means 40 in the apparatus shown in FIG. 8. In FIG. 10, the weft yarn storing cylinder 41E has the inlet guide 45*a* at the side of yarn leading-in, the outlet guide 45*b* at the side of yarn leading-out, the guide 45*a* at the side of yarn leading-in formed as the plurality of parallel pins 46*a*P spaced apart each other and the guide 45*b* at the side of yarn leading-out formed as the plurality of parallel pins 46*b*P spaced apart each other, like the weft yarn storing cylinder 41B shown in FIG. 5. Furthermore, the weft yarn storing cylinder 41E has the yarn volume detecting means 80 for detecting a volume of the weft yarn Twf stored therein and delivering an output signal corresponding to it, like the weft yarn storing cylinder 41C shown in FIG. 8.

The yarn volume detecting means 80 comprises the first sensor 81 located on the side of the weft yarn gate 42 and the second sensor 82 located on the side of the air releasing port 43. The information relating to the volume of the stored weft yarn detected by either these sensors 81 and 82 is sent to the bobbin rotation control mechanism 10C, to be used for controlling the rotation of the motor 10M.

The tension roller 32 shown in FIGS. 6 and 7 has such a mechanism that it is positioned above when the weft yarn Twf is unwound from the weft yarn bobbin 10 and automatically declines downward when the loom stops, actuating a brake for stopping the inertial rotation, as in the case with the apparatus shown in FIGS. 1 and 2.

The signals from the yarn volume detecting means 80 (the first sensor 81 located on the side of the weft yarn gate 42 and the second sensor 82 located on the side of the air releasing port 43) of the weft yarn storing cylinder 41C, 41D or 41E are used to control the drive of the motor 10M. With this constitution, the motor 10M can be controlled to ensure that the volume of the weft yarn in the weft yarn storing cylinder 41C, 41D or 41E does not become too large or too small.

That is, if the second sensor 82 located on the side of the air releasing port 43 of the weft yarn storing cylinder 41C, 41D or 41E detects that the volume of the stored weft yarn is too large, the rotation of the motor 10M is stopped based on the detection, and the feed of the weft yarn Twf from the weft yarn bobbin 10 stops. If the signal detecting the weft yarn Twf from the second sensor 82 vanishes, the motor 10M is rotated again and the feed of the weft yarn Twf is restarted.

On the other hand, if the first sensor 81 located on the side of the weft yarn gate 42 of the weft yarn storing cylinder 41C, 41D or 41E detects that the volume of the stored weft yarn is too small, the speed of the motor 10M is raised based on the detection, to increase the feed rate of the weft yarn Twf. As a result, it can be prevented that the volume of the weft yarn Twf stored in the weft yarn storing cylinder 41C, 41D or 41E becomes short.

As the first sensor 81 and the second sensor 82 for detecting the yarn, for example, phototube sensors can be used.

For the second sensor 82, a pair of phototubes (a light emitter and a light receiver) is used. The detection control system is set to ensure that in the case where the light receiver receives the light emitted from the light emitter, the rotation of the motor 10M is continued, and that in the case where the light receiver does not receive the light, the rotation of the motor 10M is stopped. The second sensor 82 is installed on the side of the air releasing port 43 beyond the predetermined position where the weft yarn Twf is bent in U shape in the weft yarn storing cylinder 41C, 41D or 41E. With this constitution, in the case where the volume of the led-in weft yarn Twf becomes too large, the weft yarn intercepts the light emitted from the light emitter. So, the light receiver cannot receive the light, and the rotation of the motor 10M is stopped.

For the first sensor 81, contrary to the second sensor 82 working as described above, the detection control system is set to ensure that in the case where the light receiver receives the light emitter from the light emitter, the rotation of the motor 10M is stopped, and that in the case where the light receiver does not receive the light, the rotation of the motor is continued. The first sensor 81 is installed near the weft yarn gate 42 in the weft yarn storing cylinder 41C, 41D or 41E. With this constitution, in the case where the volume of the led-in weft yarn Twf becomes too small, the light receiver begins to receive the light emitted from the light emitter but intercepted by the weft yarn till then, and the rotation of the motor 10M is raised.

A phototube comprising a light emitter and a light receiver integrated in such a manner that the light receiver can receive the light emitted from the light emitter and reflected can also be used. Furthermore, if the weft yarn storing cylinder 41C, 41D or 41E is formed from a transparent material such as an acrylic plate, the phototubes can also be installed outside the weft yarn storing cylinder 41C, 41D or 41E.

The rotation of the weft yarn bobbin 10 by the motor 10M causes the weft yarn Twf to be unwound from the weft yarn bobbin 10, and the weft yarn is guided along the guide roller 31*c* into the weft yarn storing cylinder 41C. The tension roller 32 has such a mechanism that it is positioned above when the weft yarn Twf is unwound from the weft yarn bobbin 10, and if the loom stops, it automatically declines downward, actuating a brake interlocked with the tension roller 32 for stopping the inertial rotation of the bobbin 10. In this case, if the tension acting on the weft yarn Twf because of the vertical motion of the tension roller 32 is larger than the tension acting on the weft yarn Twf because of the air suction in the weft yarn storing cylinder 41C, the weft yarn Twf cannot be sucked into the weft yarn storing cylinder 41C. So, the tension acting on the weft yarn Twf because of the vertical motion of the tension roller 32 must be smaller than the tension acting on the weft yarn Twf because of air suction.

The weft yarn Twf fed toward the weft yarn storing cylinder 41C, 41D or 41E from the guide roller 31*c* is guided along the inlet guide 45*a* at the side of yarn leading-in of the weft yarn storing cylinder 41C, 41D or 41E and bent in U shape in the weft yarn storing cylinder 41C, 41D or 41E, to be stored, then being guided along the outlet guide 45*b* at the side of yarn leading-out, and further guided along the horizontal guide roller 51, the vertical guide roller 52 and the horizontal guide roller 53 into the plate spring tension device 60.

The weft yarn unwinding method by means of rotation control is not limited to this method. For example, the production apparatus shown in FIG. 1 can be used to employ the method for controlling the rotation of the nip rollers 31.

As in the apparatus shown in FIG. 1, also in the apparatus shown in FIG. 6, since the weft yarn Twf is laterally unwound from the weft yarn bobbin 10, it is drawn out in the direction virtually perpendicularly to the axis of the weft yarn bobbin, being easily liberated from adhesion without causing the fluffing or breaking of the weft yarn Twf, even if the sizing agent deposited in the yarn keeps the yarn adhering to itself at adjacently placed portions on the bobbin. Furthermore, since it does not happen that the yarn is twisted whenever the yarn is unwound by a length corresponding to one turn around the bobbin, unlike the longitudinal unwinding, even if the weft yarn Twf is a flat yarn, its yarn width is stably maintained.

The weft yarn Twf unwound from the weft yarn bobbin 10 is usually positioned above in contact with the tension roller 32. In the case where the weft yarn bobbin 10 is rotated by inertia when the loom stops, the tension roller 32 automatically declines. With this constitution, the weft yarn Twf is incessantly kept loaded with a tension, and it can be prevented that the weft yarn Twf is twisted.

In the intermittent insertion of the weft yarn Twf by the rapier 21, at the moment when the insertion has been completed, it can happen that the weft yarn Twf is loosened due to inertia. However, the air suction can keep the weft yarn Twf stored in the weft yarn storing cylinder 41C, 41D or 41E, incessantly keeping it tensioned. Unless the weft yarn Twf is kept tensioned by means of air suction, the weft yarn Twf can be twisted when it is loosened, and the weft yarn, as twisted, is guided along the horizontal guide roller 51, the vertical guide roller 52 and the horizontal guide roller 53, to be woven into the fabric.

EXAMPLE 1

Carbon fiber flat yarns were used as warp yarns Twr and weft yarn Twf. Each of the flat yarns had a tensile strength of 4,900 MPa, a tensile modulus of 230 GPa, consisted of 12,000 filaments (having a fineness of 8,000 decitex), had a yarn width YW of 6.5 mm, a yarn thickness YT of 0.15 mm, and a width/thickness ratio WTR of a ratio of the yarn width YW to the yarn thickness YT of 43, and had 0.6 wt % of a sizing agent deposited. A plain-weave fabric F having a yarn density of 1.25 yarns/cm for both warp yarns Twr and weft yarns Twf, a unit weight of 200 g/m$^2$ and a fabric width of 100 cm was produced using the apparatus shown in FIGS. 1, 2 and 5 at a loom rotation of 250 rpm.

The weft yarn Twf was laterally unwound from the weft yarn bobbin 10 at a constant speed. The weft yarn storing cylinder 41B had the guide 46*a* at the side of yarn leading-in formed as the plurality of parallel pins 46*a*P spaced apart each other and the guide 46*b* at the side of yarn leading-out formed as the plurality of parallel pins 46*b*P spaced apart each other.

Every 110 cm long segment necessary for one time of weft insertion at the rapier 21 was bent in U shape in contact with the pins 46*a*P and 46*b*P in the weft yarn storing cylinder 41B, for being stored in it by means of air suction, while the weft yarn was inserted by means of the rapier 21.

The weft yarn storing cylinder 41B had a cross sectional size of 20 mm×50 mm and a length of 70 cm, and for suction, a blower having a rated suction rate of 0.6 m$^3$/min was used. After completion of the weft insertion by the rapier 21, an air jet was used to open the weft yarn Twf. The air suction rate at the weft yarn gate 42 of the weft yarn storing cylinder 41B was 1.00 m$^3$/min.

The obtained woven fabric F formed from flat yarns was free from the twisting caused while the weft yarn Twf was stored during weaving, and had few voids at the intersections between the warp yarns Twr and the weft yarns Twf, having a uniform fiber density and a fabric thickness of 0.27 mm.

One each 180° C. curable epoxy resin film with a resin unit weight of 55 g/m$^2$ was stuck to the top and bottom surfaces of the obtained woven fabric F, and the laminate was fed between calender rolls heated at 120° C., to make the woven fabric F impregnated with the resin, for producing a prepreg. Twelve sheets of the prepreg were laminated in the same direction and molded in an autoclave to produce a hardened board. The compressive properties of the board in the weft direction were evaluated according to JIS K7076 (In-Plane Compression Test Methods for Carbon Fiber Reinforced Plastics).

The results are shown in Table 1 together with the thickness of the molded board and the volume content of carbon fibers in the molded board.

COMPARATIVE EXAMPLE 1

For comparison, a woven fabric formed from carbon fiber flat yarns was produced as described in Example 1, except that the expansion and contraction of a spring was used as the weft yarn Twf storing means instead of the air suction using the weft yarn storing cylinder 41B.

Since the expansion and contraction velocities of the spring did not follow the speed of the loom, twisting occurred during weft yarn storing, and even if the weft yarn was opened by means of air, it was not widened in some portions, leaving the portions remaining narrow in yarn width. The obtained woven fabric was very rough in weave texture and had a thickness of 0.34 mm, though it had a unit weight of 200 g/m$^2$.

The obtained reinforcing fiber woven fabric was used to produce a prepreg as described in Example 1, and twelve sheets of the prepreg were laminated in the same direction and molded in an autoclave, to produce a hardened board.

In the lamination process, the resin in the voids of the woven fabric was transferred to the releasing films, to make the board partially devoid of the resin. Furthermore, since the weft yarns were partially irregular in thickness, when the woven fabric was fed between calender rolls, the weft yarns were bent. Therefore, the obtained hardened board was rugged with the surfaces dented at the portions corresponding to the voids of the woven fabric, and numerous voids were observed inside, while the weft yarns were greatly bent.

Furthermore, the hardened board was tested according to the methods of Example 1, to evaluate the in-plane compressive properties in the weft direction. The results are shown in Table 1 together with the thickness of the molded board and the volume content of carbon fibers in the molded plate.

TABLE 1

| Item | Example 1 | Comparative Example 1 |
|---|---|---|
| Thickness of molded board (mm) | 2.39 | 2.73 |
| Fiber volume content (%) (Note 1) | 56 | 49 |
| Compressive strength (MPa) (Note 2) | 945 | 531 |
| Compressive modulus (GPa) (Note 2) | 71.0 | 65.0 |

Note 1:
Fiber volume content (%) = [Volume of carbon fibers (cm$^3$)/Volume of FRP (cm$^3$)] × 100
Note 2:
Value as a board having a fiber volume content of 60%

As can be seen from the results shown in Table 1, according to the production method of Example 1, since a woven fabric could be obtained while the flat sectional form of the reinforcing fiber yarns was maintained, the obtained hardened board could effectively exhibit the high strength and high modulus of the reinforcing fibers, having a high compressive strength and a high compressive modulus.

On the other hand, in Comparative Example 1, many voids were formed in the molded board, and weaving yarns were greatly crimped at the twisted portions, while the weft yarns were bent. So, the CFRP was very low in compressive properties. For eliminating the voids in the molded board, the amount of the resin could be increased to produce a prepreg free from the portions devoid of the resin. However, in this case, the weight of the molded board would increase, and a heavy CFRP would be produced. Even if a CFRP free from the portions devoid of the resin and free from inside voids could be obtained, since the crimped weaving yarns and bent yarns would remain, the woven fabric would be lower in compressive properties than that obtained by the method of Example 1.

EXAMPLE 2

Carbon fiber flat yarns were used as warp yarns Twr and weft yarns Twf. Each of the flat yarns had a tensile strength of 4,900 MPa, a tensile modulus of 230 GPa, consisted of 12,000 filaments (having a fineness of 8,000 decitex), had a yarn width YW of 6.5 mm, a yarn thickness YT of 0.15 mm, and a width/thickness ratio WTR of a ratio of the yarn width YW to the yarn thickness YT of 43, and had 0.6 wt % of a sizing agent deposited. A plain-weave fabric F having a yarn density of 1.25 yarns/cm for both warp yarns Twr and weft yarns Twf, a unit weight of 200 g/m$^2$ and a fabric width of 100 cm was produced using the apparatus shown in FIGS. 6, 7 and 10 at a loom speed of 250 rpm.

The weft yarn Twf was laterally unwound from the weft yarn bobbin 10 while it was drawn out by rotating the motor 10M. The weft yarn storing cylinder 41E had the guide 46*a* at the side of yarn leading-in formed as the plurality of parallel pins 46*a*P spaced apart each other and the guide 46*b* at the side of yarn leading-out formed as the plurality of parallel pins 46*b*P spaced apart each other.

Every 110 cm long segment necessary for one time of weft insertion at the rapier 21 was bent in U shape in contact with the pins 46*a*P and 46*b*P in the weft yarn storing cylinder 41E, for being stored in it by means of air suction, while the weft yarn was inserted by means of the rapier 21.

The weft yarn storing cylinder 41E had a cross sectional size of 20 mm×50 mm and a length of 70 cm. At 5 cm from the weft yarn gate 42, the first sensor 81 was installed, and at 60 cm from the weft yarn gate 42, the second sensor 82 was installed. For suction, a blower with a rated suction rate of 0.6 m$^3$/min was used. After completion of the weft insertion by the rapier 21, an air jet was used to open the weft yarn Twf. The air suction rate at the weft yarn gate 42 of the weft yarn storing cylinder 41E was 1.00 m$^3$/min.

The obtained woven fabric F formed from flat yarns was free from the twisting caused while the weft yarn Twf was stored during weaving, and had few voids at the intersections between the warp yarns Twr and the weft yarns Twf, having a uniform fiber density and a fabric thickness of 0.28 mm.

One each 180° C. curable epoxy resin film with a resin unit weight of 55 g/m$^2$ was stuck to the top and bottom surfaces of the obtained woven fabric F, and the laminate was fed between calender rolls heated at 120° C., to make the woven fabric F impregnated with the resin, for producing a prepreg. Twelve sheets of the prepreg were laminated in the same direction and molded in an autoclave to produce a hardened board. The compressive properties of the board in the weft direction were evaluated according to JIS K7076 (In-Plane Compression Test Methods for Carbon Fiber Reinforced Plastics).

The results are shown in Table 2 together with the thickness of the molded board and the volume content of carbon fibers in the molded board.

COMPARATIVE EXAMPLE 2

For comparison, a woven fabric formed from carbon fiber flat yarns was produced as described in Example 2, except that the expansion and contraction of a spring was used as the weft yarn Twf storing means instead of the air suction using the weft yarn storing cylinder 41E.

Since the expansion and contraction velocities of the spring did not follow the speed of the loom, twisting occurred during weft yarn storing, and even if the weft yarn was opened by means of air, it was not widened in some portions, leaving the portions remaining narrow in yarn width. The obtained woven fabric was very rough in weave texture and had a thickness of 0.34 mm, though it had a unit weight of 200 g/m$^2$.

The obtained reinforcing fiber woven fabric was used to produce a prepreg as described in Example 2, and twelve sheets of the prepreg were laminated in the same direction and molded in an autoclave, to produce a hardened board.

In the lamination process, the resin in the voids of the woven fabric was transferred to the releasing films, to make the board partially devoid of the resin. Furthermore, since the weft yarns were partially irregular in thickness, when the woven fabric was fed between calender rolls, the weft yarns were bent. Therefore, the obtained hardened board was rugged with the surfaces dented at the portions corresponding to the voids of the woven fabric, and numerous voids were observed inside, while the weft yarns were greatly bent.

Furthermore, the hardened board was tested according to the methods of Example 2, to evaluate the in-plane compressive properties in the weft direction. The results are shown in Table 2 together with the thickness of the molded board and the volume content of carbon fibers in the molded plate.

COMPARATIVE EXAMPLE 3

For comparison, a woven fabric formed from carbon fiber flat yarns was produced as described in Example 2, except that the weft yarn storing cylinder 41E free from the guide 46*a* at the side of yarn leading-in and the guide 46*b* at the side of yarn leading-out was used for storing the weft yarn.

The weft yarn Twf was not stable in the running route in the weft yarn storing cylinder 41E, and the yarn width greatly changed while the yarn was twisted very often. Furthermore, the yarn was entangled at the turned portion of U shape due to the twisting of the yarn occurring at a frequency of about once per 5 m length of weaving, to cause weft insertion failure, lowering the production efficiency. Moreover, because of the twisting of the weft yarn Twf, even if the weft yarn Twf was opened with air after weaving, it was not widened in some portions, and the woven fabric had portions narrow in yarn width, as in Comparative Example 2. Therefore, the woven fabric was very rough in weave texture and had a thickness of 0.40 mm, though it had a unit weight of 200 g/m$^2$.

The obtained reinforcing fiber woven fabric was used to produce a prepreg as described in Example 2, and twelve sheets of the prepreg were laminated in the same direction and molded in an autoclave, to produce a hardened board.

In the lamination process, the resin in the voids of the woven fabric was transferred to the releasing films, to make the board partially devoid of the resin. Furthermore, since the weft yarns were partially irregular in thickness, when the woven fabric was fed between calender rolls, the weft yarns were bent. Therefore, the obtained hardened board was rugged with the surfaces dented at the portions corresponding to the voids of the woven fabric, and numerous voids were observed inside, while the weft yarns were greatly bent.

Furthermore, the hardened board was tested according to the methods of Example 2, to evaluate the in-plane compressive properties in the weft direction. The results are shown in Table 2 together with the thickness of the molded board and the volume content of carbon fibers in the molded plate.

TABLE 2

| Item | Example 2 | Comparative Example 2 | Comparative Example 3 |
|---|---|---|---|
| Thickness of molded board (mm) | 2.41 | 2.75 | 2.90 |
| Fiber volume content (%) (Note 1) | 56 | 48 | 45 |
| Compressive strength (MPa) (Note 2) | 950 | 520 | 410 |
| Compressive modulus (GPa) (Note 2) | 71.4 | 65.6 | 64.0 |

Note 1:
Fiber volume content (%) = [Volume of carbon fibers (cm$^3$)/Volume of FRP (cm$^3$)] × 100
Note 2:
Value as a board with a fiber volume content of 60%

As can be seen from the results shown in Table 2, according to the production method of Example 2, since a woven fabric could be obtained while the flat sectional form of the reinforcing fiber yarns was maintained, the obtained hardened board could effectively exhibit the high strength and high modulus of the reinforcing fibers, having a high compressive strength and a high compressive modulus.

On the other hand, in Comparative Examples 2 and 3, many voids were formed in the molded board, and weaving yarns were greatly crimped at the twisted portions, while the weft yarns were bent. So, the CFRP was very low in compressive properties. For eliminating the voids in the molded board, the amount of the resin could be increased to produce a prepreg free from the portions devoid of the resin. However, in this case, the weight of the molded board would increase, and a heavy CFRP would be produced. Even if a CFRP free from the portions devoid of the resin and free from inside voids could be obtained, since the crimped weaving yarns and bent yarns would remain, the woven fabric would be lower in compressive properties than that obtained by the method of Example 2.

INDUSTRIAL APPLICABILITY

According to the method and apparatus for producing a reinforcing fiber woven fabric of the invention, the weft yarn to be fed into a loom is not twisted even if the loom is operated at a high speed, and especially in the case where the weft yarn is a flat yarn, the flat state is not crushed, to allow the production of a woven fabric formed of flat yarns with their form well maintained. A woven fabric with a very thin thickness can be stably produced.

If this woven fabric is used to produce a CFRP, the ruggedness formed on the surfaces of the CFRP because of the thickness irregularity of the woven fabric attributable to the twisted portions of yarns can be prevented, and the portions excessively loaded with a resin and the portions devoid of the resin respectively occurring in the voids formed in the fabric due to the twisted portions of yarns can be prevented. Furthermore, the large crimps of weaving yarns and the bending of weft yarns based on the twisted portions of yarns can be prevented. Therefore, the compressive strength of the CFRP can be prevented from declining.

The invention claimed is:

1. A method for producing a reinforcing fiber woven fabric comprises:

forming the reinforcing fiber woven fabric by using a loom including a weft yarn bobbin being wound a weft yarn comprising a reinforcing fiber yarn, a weaving means for interlacing the weft yarn unwound from the weft yarn bobbin with plural of warp yarns each of which comprises reinforcing fiber yarn separately supplied for forming a woven fabric, a weft yarn feeding passage through which the weft yarn proceeding from the weft yarn bobbin to the weaving means is passed, a weft yarn unwinding means provided in the weft yarn feeding passage for laterally unwinding the weft yarn from the weft yarn bobbin, and a weft yarn storing means provided in the weft yarn feeding passage for temporarily storing a segment of the weft yarn proceeding to the weaving means, wherein (A) the weft yarn storing means comprises a weft yarn storing cylinder, (B) the weft yarn storing cylinder has a weft yarn gate opened to outside air at one end thereof and an air releasing port for sucking and releasing air in the weft yarn storing cylinder at the other end thereof, wherein peripheral edges of the weft yarn gate of the weft yarn storing cylinder have at least a first side and a second side parallel to each other; an inlet guide at the side of yarn leading-in is provided along the first side, to be kept in contact with the weft yarn coming from the weft yarn bobbin into the weft yarn storing cylinder; and an outlet guide at the side of yarn leading-out is provided along the second side, to be kept in contact with the weft yarn destined to go out from inside the weft yarn storing cylinder toward the weaving means, and (C) the weft yarn storing cylinder has a weft yarn contact means for forming a yarn passage by contacting with the weft yarn located therein which is drawn into the weft yarn storing cylinder through the weft yarn gate under function of air sucking and releasing brought by the air releasing port, wherein the weft yarn contact means located in the weft yarn storing cylinder comprises a guide at the side of yarn leading-in to be kept in contact with the weft yarn leading-in from the inlet guide and a guide at the side of yarn leading-out to be kept in contact with the weft yarn leading-out from the outlet guide, and a distance (L) between the guide at the side of yarn leading-in and the guide at the side of yarn leading-out in the direction perpendicular to the direction of the inlet guide gradually decreases from the weft yarn gate toward the air releasing port;

positioning the weft yarn gate along the weft yarn feeding passage;

drawing the segment of the weft yarn which is unwound from the weft yarn bobbin, passed through the weft yarn gate and proceeded to the weaving means, into the weft yarn storing cylinder under function of air sucking and releasing brought by the air releasing port; and storing temporarily the segment of the weft yarn in the weft yarn storing cylinder and supporting the weft yarn with the weft yarn contact means.

2. A method for producing a reinforcing fiber woven fabric, according to claim 1, wherein the weft yarn unwinding means has a constant speed unwinding mechanism for unwinding the weft yarn from the weft yarn bobbin at a constant speed and a tensioning mechanism for imparting a tension regularly to the weft yarn.

3. A method for producing a reinforcing fiber woven fabric, according to claim 1, wherein the weft yarn unwinding means has a bobbin rotating mechanism for rotating the weft yarn bobbin; and the weft yarn storing cylinder has a yarn volume detecting means for detecting a volume of the weft yarn located in the weft yarn storing cylinder and delivering an output signal corresponding to the volume detected, and a bobbin rotation control mechanism for controlling a rotation of the weft yarn bobbin by the bobbin rotating mechanism based on the output signal.

4. A method for producing a reinforcing fiber woven fabric, according to claim 1, wherein the weft yarn unwinding means has a bobbin rotating mechanism for rotating the weft yarn bobbin, and a tensioning mechanism for imparting a tension regularly to the weft yarn; and the weft yarn storing cylinder has a yarn volume detecting means for detecting a volume of the weft yarn located in the weft yarn storing cylinder and delivering an output signal corresponding to the volume, and a bobbin rotation control mechanism for controlling the rotation of the weft yarn bobbin by the bobbin rotating mechanism based on the output signal.

5. A method for producing a reinforcing fiber woven fabric, according to claim 1, wherein the guide at the side of yarn leading-in and the guide at the side of yarn leading-out are respectively formed of an air permeable sheet.

6. A method for producing a reinforcing fiber woven fabric, according to claim 1, wherein the guide at the side of yarn leading-in and the guide at the side of yarn leading-out are respectively formed of a plurality of parallel rods spaced apart each other.

7. A method for producing a reinforcing fiber woven fabric, according to claim 1, wherein a cross sectional figure of the inner circumferential surface of the weft yarn storing cylinder is rectangular.

8. A method for producing a reinforcing fiber woven fabric, according to claim 7, wherein the inlet guide is located along one of the short sides of the rectangle and the outlet guide is located along the other short side of the rectangle.

9. A method for producing a reinforcing fiber woven fabric, according to claim 1, wherein a suction rate of air from the weft yarn gate due to an action at the air releasing port is in a range from 0.05 to 100 $m^3$/min.

10. A method for producing a reinforcing fiber woven fabric, according to claim 1, wherein a rotational speed of the loom is in a range from 100 to 400 rpm.

11. A method for producing a reinforcing fiber woven fabric, according to claim 1, wherein the reinforcing fiber yarns forming the warp yarns and the weft yarns in the woven fabric satisfy the following relations:

$$YW \geqq 4 \text{ mm},$$

$$WTR = 40 \text{ to } 100,$$

$$YWvc \leqq 10\%, \text{ and}$$

$$W \min PR \geqq 0.8,$$

where YW is a yarn width of each of the reinforcing fiber yarns; YT is a yarn thickness; WTR is a width/thickness ratio (YW/YT) of the yarn width (YW) to the yarn thickness (YT); YWvc is a yarn width variation coefficient; YWmin is the minimum yarn width; YP is a weaving yarn pitch; and WminPR is a width/pitch ratio(YWmin/YP) of the minimum yarn width (YWmin) to the weaving yarn pitch (YP).

12. A method for producing a reinforcing fiber woven fabric, according to claim 11, wherein the total fineness of each of the reinforcing fiber yarns is in a range from 500 to 70,000 decitex.

13. A method for producing a reinforcing fiber woven fabric, according to claim 11, wherein the woven fabric satisfies $$FCf = 98 \text{ to } 100\%,$$

where FCf is a cover factor of the woven fabric.

14. A method for producing a reinforcing fiber woven fabric, according to any one of claims 11 to 13, wherein the reinforcing fiber yarns are carbon fiber yarns.

15. An apparatus for producing a reinforcing fiber woven fabric by using a loom which comprises a weft yarn bobbin being wound a weft yarn comprising a reinforcing fiber yarn, a weaving means for interlacing the weft yarn unwound from the weft yarn bobbin with plural of warp yarns each of which comprises a reinforcing fiber yarn separately supplied for forming a woven fabric, a weft yarn feeding passage through which the weft yarn proceeding from the weft yarn bobbin to the weaving means is passed, a weft yarn unwinding means provided in the weft yarn feeding passage for laterally unwinding the weft yarn from the weft yarn bobbin, and a weft yarn storing means provided in the weft yarn feeding passage for temporarily storing a segment of the weft yarn proceeding to the weaving means, wherein (A) the weft yarn storing means comprises a weft yarn storing cylinder, (B) the weft yarn storing cylinder has a weft yarn gate opened to outside air at one end thereof and an air releasing port for sucking and releasing air in the weft yarn storing cylinder at the other end thereof, wherein peripheral edges of the weft yarn gate of the weft yarn storing cylinder have at least a first side and a second side parallel to each other; an inlet guide at the side of yarn leading-in is provided along the first side, to be kept in contact with the weft yarn coming from the weft yarn bobbin into the weft yarn storing cylinder; and an outlet guide at the side of yarn leading-out is provided along the second side, to be kept in contact with the weft yarn destined to go out from inside the weft yarn storing cylinder toward the weaving means, and (C) the weft yarn storing cylinder has a weft yarn contact means for forming a yarn passage by contacting with the weft yarn located therein which is drawn into the weft yarn storing cylinder through the weft yarn gate under function of air sucking and releasing brought by the air releasing port, wherein the weft yarn contact means located in the weft yarn storing cylinder comprises a guide at the side of yarn leading-in to be kept in contact with the weft yarn leading-in from the inlet guide and a guide at the side of yarn leading-out to be kept in contact with the weft yarn leading-out from the outlet guide, and a distance (L) between the guide at the side of yarn leading-in and the guide at the side of yarn leading-out in the direction perpendicular to the direction of the inlet guide gradually decreases from the weft yarn gate toward the air releasing port; and (D) the weft yarn gate is positioned in face to the weft yarn feeding passage.

16. An apparatus for producing a reinforcing fiber woven fabric, according to claim 15, wherein the weft yarn unwinding means has a constant speed unwinding mechanism comprising nip rollers for unwinding the weft yarn from the weft yarn bobbin at a constant speed, and a tensioning mechanism comprising a tension roller for imparting a tension regularly to the weft yarn.

17. An apparatus for producing a reinforcing fiber woven fabric, according to claim 15, wherein the weft yarn unwinding means has a bobbin rotating mechanism comprising a bobbin rotating drive motor for rotating the weft yarn bobbin, and a tensioning mechanism comprising a tension roller for imparting a tension regularly to the weft yarn; and the weft yarn storing cylinder has a yarn volume detecting means for detecting a volume of the weft yarn located in the weft yarn storing cylinder and delivering an output signal corresponding to the volume detected, and a bobbin rotation control mechanism for controlling a rotation of the weft yarn bobbin by the bobbin rotating mechanism based on the output signal.

18. An apparatus for producing a reinforcing fiber woven fabric, according to claim 15, wherein the guide at the side of yarn leading-in and the guide at the side of yarn leading-out are respectively formed of an air permeable sheet.

19. An apparatus for producing a reinforcing fiber woven fabric, according to claim 15, wherein the guide at the side of yarn leading-in and the guide at the side of yarn leading-out are respectively formed of a plurality of parallel rods spaced apart each other.

20. An apparatus for producing a reinforcing fiber woven fabric, according to claim 15, wherein a cross sectional figure of the inner circumferential surface of the weft yarn storing cylinder is rectangular.

21. An apparatus for producing a reinforcing fiber woven fabric, according to claim 20, wherein the inlet guide is located along one of the short sides of the rectangle and the outlet guide is located along the other short side of the rectangle.

22. An apparatus for producing a reinforcing fiber woven fabric, according to claim 15, wherein a suction rate of air from the weft gate due to an action at the air releasing port is in a range from 0.05 to 100 $m^3$/min.

23. An apparatus for producing a reinforcing fiber woven fabric, according to claim 15, wherein a rotational speed of the loom is in a range from 100 to 400 rpm.

24. A reinforcing fiber woven fabric is a bi-directional woven fabric formed with warp yarns comprising reinforcing fiber yarns and weft yarns comprising reinforcing fiber yarns, wherein the woven fabric satisfies the following relations:

$$YW \geqq 4 \text{ mm},$$

$$WTR = 40 \text{ to } 100,$$

$$YWvc \leqq 10\%, \text{ and}$$

$$W \min PR \geqq 0.8,$$

where YW is a yarn width of each of the reinforcing fiber yarns; YT is a yarn thickness; WTR is a width/thickness ratio (YW/YT) of the yarn width (YW) to the yarn thickness (YT); YWvc is a yarn width variation coefficient; YWmin is the minimum yarn width; YP is a weaving yarn pitch; and WminPR is a width/pitch ratio (YWmin/YP) of the minimum yarn width (YWmin) to the weaving yarn pitch (YP).

25. A reinforcing fiber woven fabric, according to claim 24, wherein the total fineness of each of the reinforcing fiber yarns is in a range from 500 to 70,000 decitex.

26. A reinforcing fiber woven fabric, according to claim 24, wherein the woven fabric satisfies $$FCf = 98 \text{ to } 100\%,$$

where FCf is a cover factor of the woven fabric.

27. A reinforcing fiber woven fabric, according to any one of claims 24 through 26, wherein the reinforcing fiber yarns are carbon fiber yarns.

28. A method for producing a reinforcing fiber woven fabric, said method comprising the steps of:

laterally unwinding a weft yarn comprising a reinforcing fiber yarn from a weft yarn bobbin;

passing the weft yarn along a weft yarn feeding passage;

drawing a segment of the weft yarn through an opened end of a weft yarn gate into a weft yarn storing cylinder and toward an air releasing port, thereby storing temporarily the segment of the weft yarn in the weft yarn storing cylinder;

supporting the weft yarn in the weft yarn storing cylinder with a guide at a yarn leading-in side of the weft yarn storing cylinder and a guide at a yarn leading-out side of the weft yarn storing cylinder, wherein a distance between the guides gradually decreases toward the air releasing port, thereby forming a yarn passage;

advancing the weft yarn from the weft yarn storing cylinder along the weft yarn feeding passage; and interlacing the weft yarn with warp yarns comprising reinforcing fiber yarn.

29. An apparatus for producing a reinforcing fiber woven fabric, said apparatus comprising:

a weft yarn bobbin wound with weft yarn comprising a reinforcing fiber yarn;

means for laterally unwinding the weft yarn from said weft yarn bobbin;

means for weaving the weft yarn unwound from said weft yarn bobbin with warp yarns comprising a reinforcing fiber yarn;

a weft yarn feeding passage between said weaving means and said unwinding means through which the weft yarn is passed; and a weft yarn storing cylinder provided along said weft yarn feeding passage for temporarily storing a segment of the weft yarn, said weft yarn storing cylinder having a weft yarn gate opened at one end thereof, a port for sucking and releasing air in said weft yarn storing cylinder at the other end thereof, and means for forming a yarn passage by contacting weft yarn drawn into said weft yarn storing cylinder through said weft yarn gate under suction applied through said ports, said yarn passage forming means comprising a guide at a yarn leading-in side of said weft yarn storing cylinder and a guide at a yarn leading-out side of said weft yarn storing cylinder, wherein a distance between said guide at the yarn leading-in side and said guide at the yarn leading-out side gradually decreases from the weft yarn gate toward said port.

* * * * *